US006433482B1

(12) United States Patent
Curry et al.

(10) Patent No.: US 6,433,482 B1
(45) Date of Patent: Aug. 13, 2002

(54) BARIUM LIGHT SOURCE METHOD AND APPARATUS

(75) Inventors: John J. Curry, Madison, WI (US); Jeffrey MacDonagh-Dumler, Cambridge, MA (US); Heidi M. Anderson, Cleveland Heights, OH (US); James E. Lawler, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 09/309,068

(22) Filed: May 10, 1999

Related U.S. Application Data

(60) Provisional application No. 60/085,046, filed on May 11, 1998.

(51) Int. Cl.[7] ..... H01J 17/20; H01J 61/18; H01J 61/12

(52) U.S. Cl. ..... 313/637; 313/638; 313/643; 313/567; 315/248

(58) Field of Search ..... 313/637, 152–162, 313/638–643, 311, 576, 567; 315/248

(56) References Cited

U.S. PATENT DOCUMENTS

| | | | | |
|---|---|---|---|---|
| 3,234,421 A | * | 2/1966 | Reiling | 313/25 |
| 3,649,550 A | | 3/1972 | Chenot | |
| 3,651,363 A | | 3/1972 | Barry | |
| 3,693,006 A | | 9/1972 | Chenot | |
| 4,082,392 A | * | 4/1978 | Golin | 316/19 |
| 4,110,660 A | | 8/1978 | Wolfe | |
| 4,112,328 A | | 9/1978 | Wolfe et al. | |
| 4,152,619 A | | 5/1979 | Bhalla | |
| 4,185,222 A | | 1/1980 | Van den Boom et al. | |

(List continued on next page.)

OTHER PUBLICATIONS

A.G. Jack, "Low–Pressure Mercury and Sodium Lamps," Radiative Processes in Discharge Plasmas, (book), Plenum Press, New York, 1986, pp. 309–326.

John F. Waymouth, "Light Sources," Encyclopedia of Physical Science and Technology, Second Edition, vol. 8, Academic Press, Inc., 1992, pp. 697–730

John F. Waymouth, "Introduction and Background . . . Where we are in Light Source Performance . . . Where we Would Like to Get," ALITE 95 Workshop, Feb. 8, 1995.

James T. Dakin, "Tutorial on Metal Halide Lamp Science," ALITE 95 Workshop, Feb. 8, 1995.

Heidi M. Anderson, et al., "Radiometric Efficiency of Barium Discharge Plasma," Abstract Submitted for the 24$^{th}$ IEEE International Conference on Plasma Science, May 19–22, 1997, San Diego, California, published in International Conference on Plasma Science Bulletin, May, 1997.

(List continued on next page.)

*Primary Examiner*—Nimeshkumar D. Patel
*Assistant Examiner*—Karabi Guharay
(74) *Attorney, Agent, or Firm*—Foley & Lardner

(57) ABSTRACT

Visible light emission is obtained from a plasma containing elemental barium including neutral barium atoms and barium ion species. Neutral barium provides a strong green light emission in the center of the visible spectrum with a highly efficient conversion of electrical energy into visible light. By the selective excitation of barium ionic species, emission of visible light at longer and shorter wavelengths can be obtained simultaneously with the green emission from neutral barium, effectively providing light that is visually perceived as white. A discharge vessel contains the elemental barium and a buffer gas fill therein, and a discharge inducer is utilized to induce a desired discharge temperature and barium vapor pressure therein to produce from the barium vapor a visible light emission. The discharge can be induced utilizing a glow discharge between electrodes in the discharge vessel as well as by inductively or capacitively coupling RF energy into the plasma within the discharge vessel.

18 Claims, 25 Drawing Sheets

U.S. PATENT DOCUMENTS

| | | | | | |
|---|---|---|---|---|---|
| 4,321,503 | A | | 3/1982 | Bhalla | |
| 4,431,942 | A | | 2/1984 | Thornton | |
| 4,590,405 | A | | 5/1986 | Hoeks et al. | |
| 4,672,267 | A | * | 6/1987 | Lapatovich et al. | 313/571 |
| 4,748,391 | A | | 5/1988 | Sigai et al. | |
| 4,827,187 | A | | 5/1989 | Verlijsdonk | |
| 4,961,020 | A | * | 10/1990 | Strok | 313/25 |
| 5,185,180 | A | | 2/1993 | Kasenga et al. | |
| 5,194,332 | A | | 3/1993 | Kasenga et al. | |
| 5,223,341 | A | | 6/1993 | Sigai | |
| 5,508,592 | A | | 4/1996 | Lapatovich et al. | |
| 5,539,276 | A | | 7/1996 | Exell et al. | |
| 5,550,431 | A | | 8/1996 | Duggan et al. | |
| 5,552,216 | A | | 9/1996 | Sugimoto et al. | |
| 5,585,692 | A | | 12/1996 | Sugimoto et al. | |
| 5,798,611 | A | * | 8/1998 | Dolan et al. | 313/570 |
| 5,847,517 | A | * | 12/1998 | Ury et al. | 315/248 |
| 6,121,730 | A | * | 9/2000 | Ukegawa et al. | 313/638 |
| 6,157,133 | A | * | 12/2000 | Shamamian et al. | 313/638 |

OTHER PUBLICATIONS

Heidi M. Anderson, et al., "Radiometric Efficiency of Barium Discharge Plasmas," Abstract Submitted for the gec97 Meeting of The American Physical Society, published in the Bulletin of the American Physical Society, Oct., 1997.

Jeff MacDonagh–Dumler, et al., "Barium Discharge Plasma Apparatus," Abstract Submitted for the gec97 Meeting of The American Physical Society, published in the Bulletin of the American Physical Society, Oct., 1997.

* cited by examiner

Barium discharge emission spectra;
T=675 °C and $P_{Ar}$ =0.12 Torr

Barium discharge emission spectra;
T=675°C and $P_{Ar}$=0.25 Torr

Barium discharge emission spectra;
T = 675°C and $P_{Ar}$=0.5 Torr

Barium discharge emission spectra;

T= 675 °C and $P_{Ar}$ = 1 Torr

Barium discharge emission spectra;
T = 675 °C and $P_{Ar}$ = 2 Torr

Barium discharge emission spectra;
T = 675 °C and $P_{Ar}$ = 4 Torr

Barium discharge emission spectra;
T = 675 °C and $P_{Ar}$ = 8 Torr

BARIUM LIGHT SOURCE METHOD AND APPARATUS

REFERENCE TO RELATED APPLICATION

This application claims the benefit of provisional patent application No. 60/085,046, filed May 11, 1998, the disclosure of which is incorporated by reference.

This invention was made with United States government support awarded by the following agencies: DOC Grant No.: 70NANB3H1372; DOD-ARMY Grant No(s): DAAH04-96-1-0413; DAAH04-93-G-0185; and DAAH04-93-G-0260; NASA Grant No(s): NAGW-2908; NAG-5-4259; NAG-5-6833; NSF Grant No(s): ECS-9320515; ECS-9710234; AST-9318386. The United States has certain rights in this invention.

FIELD OF THE INVENTION

This invention pertains generally to the field of light sources and particularly to plasma discharge light sources.

BACKGROUND OF THE INVENTION

Many types of light sources have been investigated and to some extent commercially developed in an effort to improve upon the efficiency of the traditional incandescent lamps. While incandescent lamps provide light which has a satisfactory "white" spectrum as perceived by human observers, the efficiency of the incandescent lamp in converting electrical energy to luminescence in visible wavelengths is relatively low. Commercial alternatives to incandescent lamps which have a higher efficiency in conversion of electrical energy to visible light include tungsten-halogen lamps, fluorescent lamps, metal halide lamps, high pressure sodium lamps, and low pressure sodium lamps. The development of alternative lighting sources continues to be an important area of research for several reasons. First, lighting accounts for approximately 20 to 25 percent of the total electrical power consumption in the United States. Second, there has been little increase in the amount of white light yielded per watt of power during the last 15 to 20 years, due, in part, to the numerous requirements placed on light sources. For example, sodium lights are efficient, but produce a monochromatic yellow-orange color. While incandescent bulbs produce an acceptable white light, they are only 1/10 as efficient as low pressure sodium lights. A third factor is a demand for a substitute for fluorescent light technology. Fluorescent lights contain mercury, a well-known bioaccumulative neurotoxin. Currently, there are no practical substitutes for mercury-based white light technology.

SUMMARY OF THE INVENTION

In accordance with the present invention, visible light emission is obtained from a plasma containing elemental barium. Elemental neutral barium provides a strong green light emission in the center of the visible spectrum with a conversion of electrical energy in the plasma discharge into visible light. In accordance with the invention, by the selective excitation of barium ionic species in the plasma discharge, emission of visible light at longer and shorter wavelengths—red and blue—can be obtained simultaneously from the plasma discharge with the green emission from neutral barium, effectively providing light that is visually perceived as white. Appropriate selection of the plasma conditions allows selection of the perceived coloration of the light from the source.

A device for emitting visible light in accordance with the invention comprises a discharge vessel which contains elemental barium and a buffer fill gas, which is preferably a noble gas (e.g., argon, helium, xenon, krypton and neon). A discharge inducer is coupled to the discharge vessel to induce a desired temperature and a desired barium vapor pressure in the discharge vessel, producing barium vapor which mixes with the fill gas. The discharge inducer excites a plasma in the barium vapor and the fill gas and induces visible light emission from the plasma. The discharge inducer may comprise a DC or AC power source coupled to electrodes within the vessel to provide an electrical discharge across the electrodes and thereby induce the discharge in the fill gas and in the barium vapor. The discharge inducer may also comprise a coil coupling radio frequency (RF) power from an RF power source inductively to the plasma within the vessel. The discharge inducer may also comprise a capacitive coupler for coupling RF power to the plasma.

To maintain the temperatures required for barium vaporization within the discharge vessel, thermal insulation may be provided around the discharge vessel. Such thermal insulation may comprise a partial jacket of insulating material or a thermal vacuum jacket of transparent glass which is evacuated between the jacket and the discharge vessel.

Appropriate selection of the mixture of neutral barium atoms and barium ions in the discharge plasma may be utilized to select the perceived color of the light emission. Neutral barium atoms in the plasma emit at wavelengths centered at 5535 Angstroms, while barium ions emit at wavelengths centered at 4934, 4554, 6141 and 6496 Angstroms. Thus, by appropriate selection of the mixture of ions and neutral barium atoms in the plasma, a desired balance of emission wavelengths may be obtained, including light that is perceived as substantially white.

In the method of carrying out the invention to provide visible light, the discharge vessel with fill gas and an elemental barium dose therein (e.g., a block of pure elemental barium) may be provided, with power then being applied from a power source to the discharge vessel to increase the temperature of the gas fill and the barium to achieve a desired operating temperature to cause the barium to vaporize. The vapor and fill gas are excited to produce a visible light discharge emission from the discharge vessel. The pressure within the discharge vessel or power and temperature may be adjusted to adjust the visible light discharge emission and to select a desired color hue for the emission. Energy may be provided to excite the plasma by an electrical discharge across electrodes in the discharge vessel, by inductively coupling radio frequency power to the plasma, by capacitively coupling radio frequency power to the plasma, or in other conventional manners.

Further in accordance with the invention, a method of converting electrical energy to visible light comprises enclosing a source of elemental barium in a sealed vessel with a fill gas at a desired pressure, exciting the gas within the vessel to heat the barium to evaporate barium atoms and to provide a barium vapor in the vessel, applying energy to the barium vapor to provide a plasma comprising a mixture of neutral barium and barium ions, and to excite emission from the elemental barium and the barium ions to emit light at wavelengths characteristic of the neutral barium and barium ion species. The energy may be applied to the plasma by applying an electrical discharge across electrodes within the vessel or by coupling radio frequency energy into the plasma capacitively or inductively.

In accordance with the invention, the fill gas utilized within the discharge vessel may comprise one of the noble gases without the necessity for utilizing a mercury vapor. Because mercury is not required, the problem of disposal that is incurred with conventional light sources which require mercury, such as fluorescent lights and various types of mercury lamps, can be avoided.

Further objects, features and advantages of the invention will be apparent from the following detailed description when taken in conjunction with the accompanying drawings.

DETAILED DESCRIPTION OF THE INVENTION

The present invention is based on the utilization of barium as an atomic radiator. Barium has desirable characteristics for utilization as a high efficiency white light radiator for several reasons.

First, the vapor pressure of barium is in the range of 1 to 20 mTorr at a reasonable operating temperature. Barium has a vapor pressure of 3 mTorr at 840 K. While the operating temperature of a barium glow discharge must be higher than for other atomic radiators (e.g., mercury and sodium), such operating temperatures are still within the practical material limitations of commonly used transparent materials such as fused silica or polycrystalline alumina. However, other factors such as the chemical compatibility of hot barium and fused silica or PCA (polycrystalline alumina) may require a protective coating or transparent barium-resistant materials Second, barium has a satisfactory resonance wavelength for direct lighting use. One of the problems with mercury-based (e.g., fluorescent) lighting is that most of the emission lies within the UV, so it is not only invisible to the human eye, but also is dangerous. Phosphors coat the inside of mercury fluorescent lamps and convert the UV radiation into visible light. While the phosphor material can achieve near perfect quantum efficiency (i.e., one photon of UV into one photon of visible light), a significant energy loss occurs:

$$E_{one\ photon}=h\nu \text{ and } \nu_{uv}\approx 2^*\nu_{visible} \Rightarrow E_{uv}\approx 2^*E_{visible}$$

Figure 1:
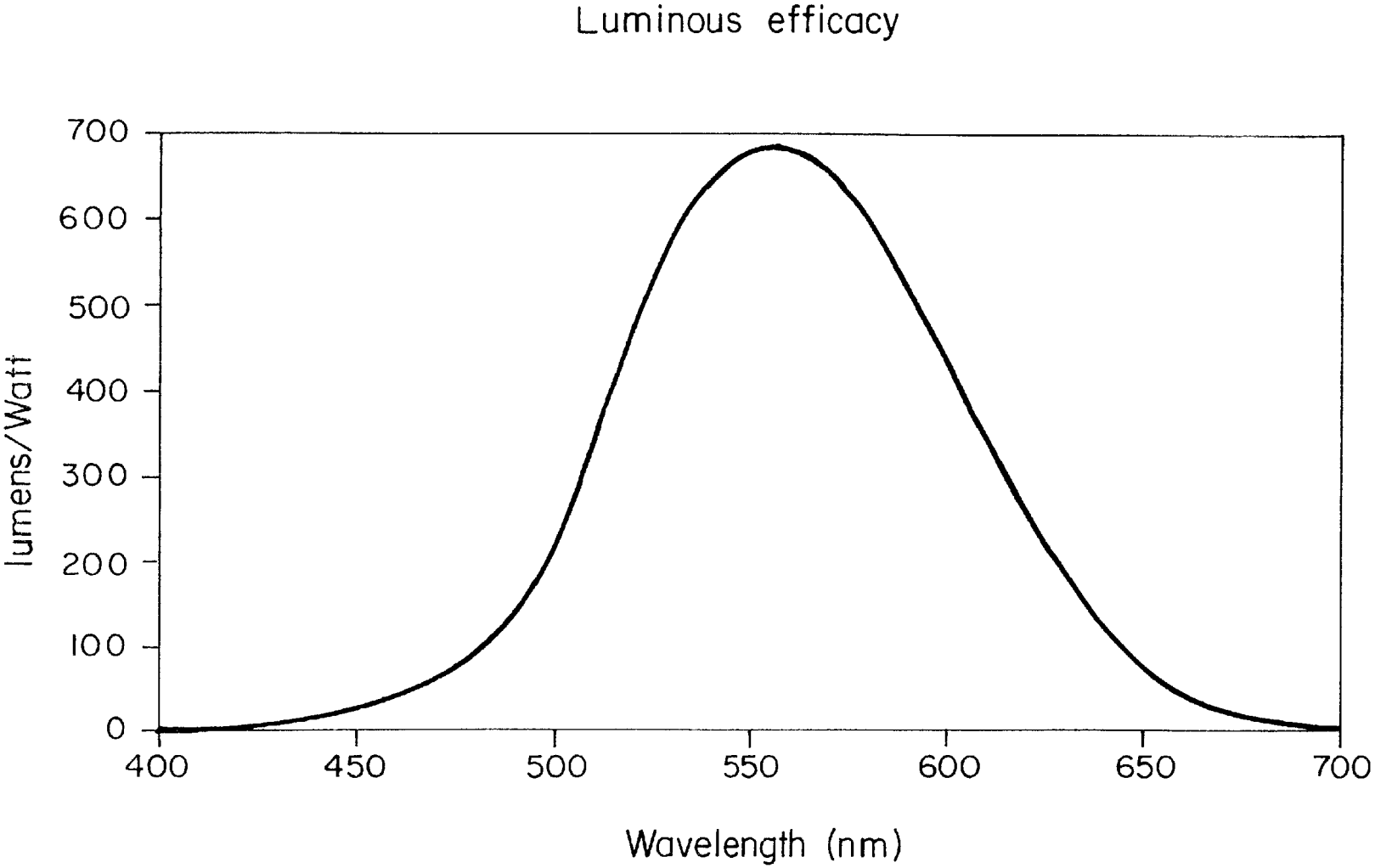
FIG. 1 is a diagram of luminosity function in lumens/watt versus wavelength.

This Stokes shift implies an energy loss of about 50%. However, the barium singlet 6 p resonance wavelength is at 554 nm. This transition lies on the peak of the eye sensitivity curve (i.e., green), and thus yields a high luminous efficacy, as illustrated by the eye sensitivity curve in FIG. 1. Luminous efficacy is defined as the amount of useful light yielded from a source per unit power input. In addition, barium ion lines observed in the RF discharge are in the red and blue spectral areas, thus enabling an overall white light to be obtained.

Finally, a barium discharge emits visible light from a resonance transition that has an excitation energy less than half of the ionization energy. The singlet 6 p resonance level of barium is 2.2 eV above the ground state while the ionization potential is 5.2 eV. When the excitation energy is greater than half the ionization energy, a collision of two excited atoms will probably lead to ionization of one atom and the second atom returning to ground state. This produces an increase in the ion population and a decrease in the resonance level (excited atom) population. Therefore, barium has the potential to efficiently use input power to generate resonance level excitation.

Figure 2:
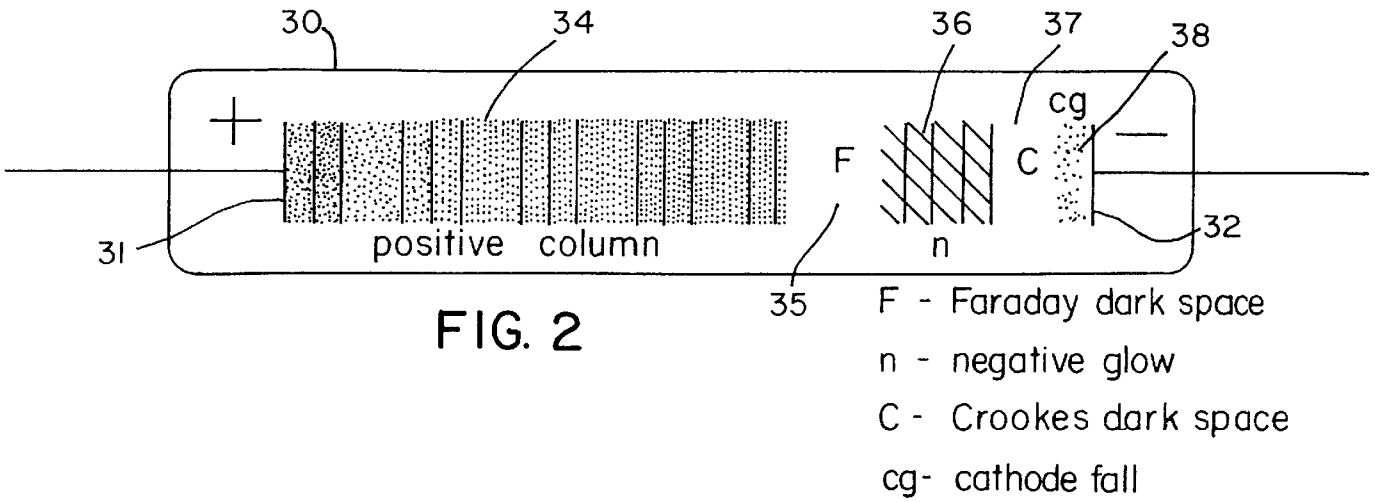
FIG. 2 is a simplified diagram of a DC discharge vessel and the regions therein between the positive and negative electrodes.
Figure 3:
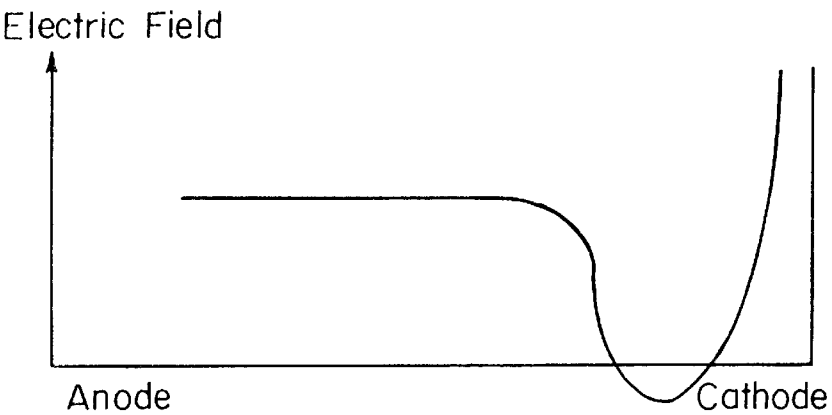
FIG. 3 is a diagram of electric field versus position between the anode and the cathode for the discharge vessel of FIG. 2.

A first challenge is to construct a cell or vessel in which a reliable barium discharge can be maintained. Known barium DC discharge cell designs serve non-radiometric functions. Accurate radiometric calibration demands access to different measurable parameters than other spectroscopic experiments. Most importantly, there needs to be a way of measuring the emission from the positive column. With reference to FIG. 2, for purposes of illustration, a discharge is established within a discharge vessel 30 between an anode 31 and a cathode 32 (positive and negative electrodes), and the typical discharge includes a positive column 34, a Faraday dark space 35, a negative glow 36, a Crooks dark space 37 including cathode fall 38. The positive column 34 is the region in a glow discharge where most of the light is produced. For lighting applications, it is essential to optimize the length and radiant power of the positive column. The electric field between the anode and cathode is illustrated in FIG. 3.

However, the chemical reactivity and the relatively high temperature required to produce a few mTorr Ba vapor pressure present challenges in creating and observing a Ba glow discharge. At the temperature required for sufficient Ba vapor pressure, the hot Ba will darken most transparent discharge envelope materials. A novel design for a DC discharge apparatus was constructed to meet this challenge as illustrated in FIG. 4.

Figure 4:
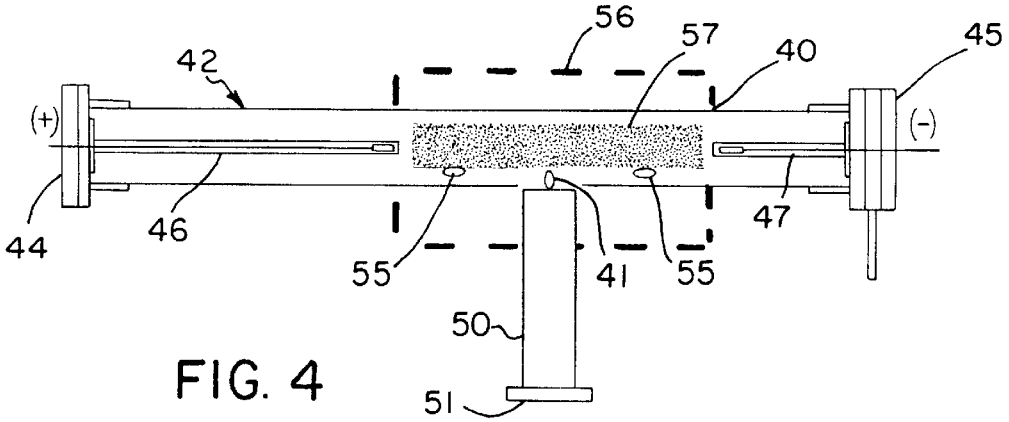
FIG. 4 is a simplified diagram of a discharge device in accordance with the invention incorporating a barium discharge vessel.

In the discharge apparatus of FIG. 4, the discharge vessel comprises a quartz liner 40 with an opening 41 therein, a surrounding quartz vacuum envelope 42, stainless steel flanges 44 and 45 at the positive and negative ends of the apparatus, a positive electrode 46 (anode) and a negative electrode 47 (cathode) extending through the end flanges 44 and 45, respectively, a quartz tube 50 extending from the opening 41, and a quartz window 51 mounted to the end of the tube 50. Blocks of metallic barium 55 are provided within the quartz liner 40, and the active discharge area between electrodes 46 and 47 is enclosed within an oven 56 shown schematically in FIG. 4. The barium positive column 57 is generated between the electrodes 46 and 47 and is centered at the opening 41. Quartz is preferred as the vacuum envelope to provide a nonconductive enclosure for the plasma discharge. To the extent possible, the deposit of barium films on the cell or vessel walls should be avoided, because barium is a conducting material so that current may short out to the barium coated walls instead of striking across the barium vapor to produce glow discharge.

Figure 5:
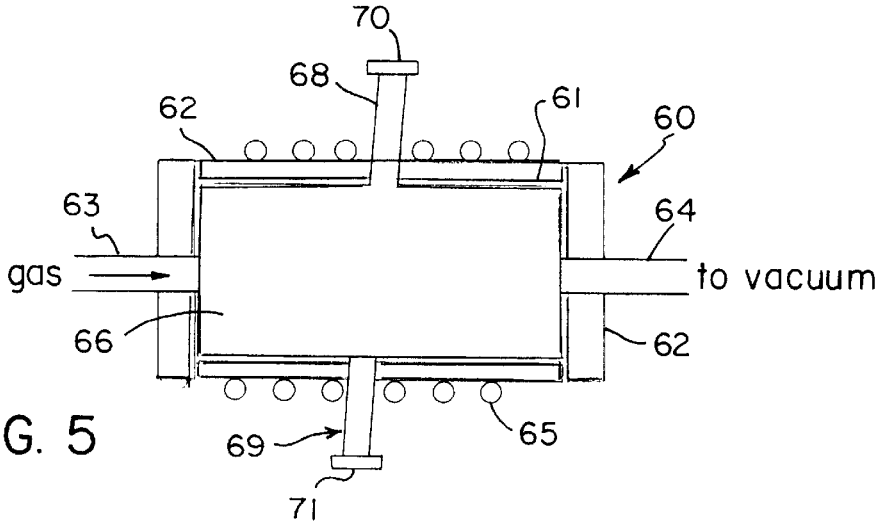
FIG. 5 is a simplified diagram of an RF discharge device having inductive coupling of RF power to the plasma within the discharge vessel.
Figure 6:
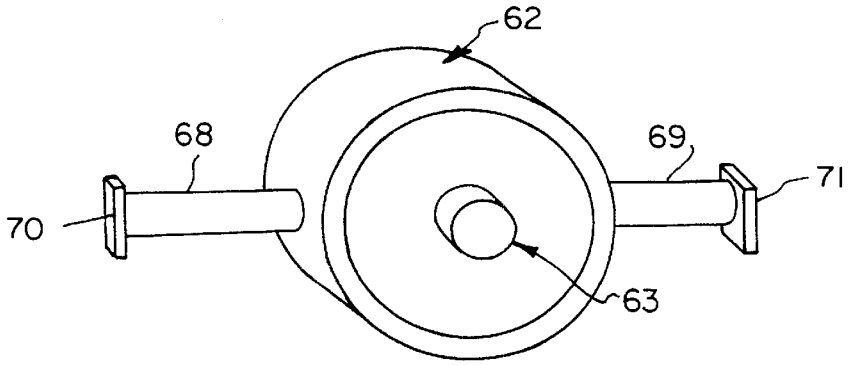
FIG. 6 is a partial perspective view of the discharge device of FIG. 5.

The present invention may also be embodied in a radio frequency (RF) coupled discharge as illustrated in FIGS. 5 and 6. The RF discharge apparatus 60 of FIGS. 5 and 6 has a cylindrical discharge vessel 61 formed, for example, of quartz, with insulation (e.g., fiberglass) 62 placed partially around it. An input line 63 provides a gas inlet and an output line 64 leads to a vacuum pump. Cooled copper coils 65 are utilized to provide inductive coupling of RF energy to the plasma within the enclosed region 66 within the vessel 61. Quartz tubes 68 and 69, having quartz windows 70 and 71, allow exit of the light emitted within the plasma region 66.

An RF discharge has several advantages over an electrode discharge system. First, because it is electrodeless, some of the potential chemical problems due to barium interactions with electrodes and their seals are avoided. Second, it requires no external method of heating as a DC discharge does. The discharge vessel 61 can be filled with a noble gas, such as helium, neon, argon, krypton, or xenon, and a discharge can be ignited in the noble gas. As the noble gas discharge power increases, the temperature of the cell increases dramatically, with a corresponding increase in the barium vapor pressure and a transition from the noble gas discharge to a barium discharge. The discharge cell 60 of FIGS. 5 and 6 is constructed to avoid chemical attack on the windows of the cell since the barium condenses on the walls before reaching the windows 70 and 71, providing convenient access to the plasma emission.

Operation of RF, or radio frequency, discharge involves several principles. First, the barium plasma has a complex impedance. In other words, it acts as a component in an electrical circuit, with the properties of the plasma being described by a complex plasma conductivity. The real part of the plasma conductivity defines the plasma resistance, whereas the imaginary part defines the plasma reactance. There are inductive characteristics of the plasma due to the current path formed within the discharge and self-inductance.

Figure 7:
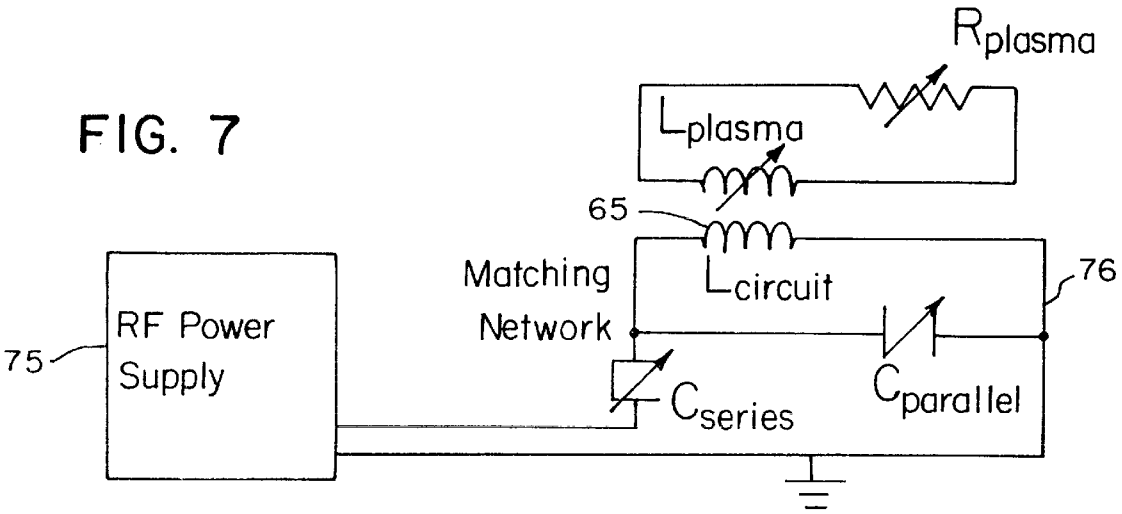
FIG. 7 is a schematic circuit diagram for the inductively coupled RF discharge device of FIG. 5.

The second principle is that the total resistance, or impedance, of the RF power supply circuit and the plasma "circuit" should match for optimal coupling. Coupling is the process by which the power is inductively transferred to the plasma. If the impedance of the plasma doesn't match well with the power supply impedance, then the input power will be "reflected," thus lowering the absorbed power. Furthermore, high reflected powers run the danger of shorting the circuit across the tunable capacitors. FIG. 7 is a schematic drawing that approximates the RF discharge circuit, with power supplied from an RF power supply 75 of conventional design through a matching network 76 that matches the effective impedance of the plasma.

It is preferred that the inductive elements of the circuit of FIG. 7 are placed inside a Faraday cage to keep interference down. The RF power generator 75 emits a strong signal at, e.g., 13.56 MHz, and without isolation other adjacent electrical equipment would be affected. The Faraday cage may be formed as a frame box with metal screen wrapped around it. As the oscillating EM waves hit the metal screen, they effectively see it as a solid wall. To demonstrate this we note that the reason light passes through the screen easily is that the hole width is much larger than the wavelength of the light. However:

$$\lambda_{rf}=c/\nu_{rf}=(3.0\times10^{8}\ \text{m/s})/(13.56\times10^{6}\ 1/\text{s})=22\ \text{meters}$$

so the hole width of the screen (≈millimeters) is much smaller than the wavelength of the RF waves.

The inductor 65 may be a copper tube wrapped around the cylindrical plasma cell 61. Cooling water is run through the tubes to prevent heating and increased resistive losses. The relatively high temperatures of a barium plasma increases the necessity of this feature. However, high plasma temperatures are desired. The fiberglass insulation 62, placed between the copper tubes and the cylindrical glass cell, aids in maintaining a high temperature within the discharge vessel.

Figure 8:
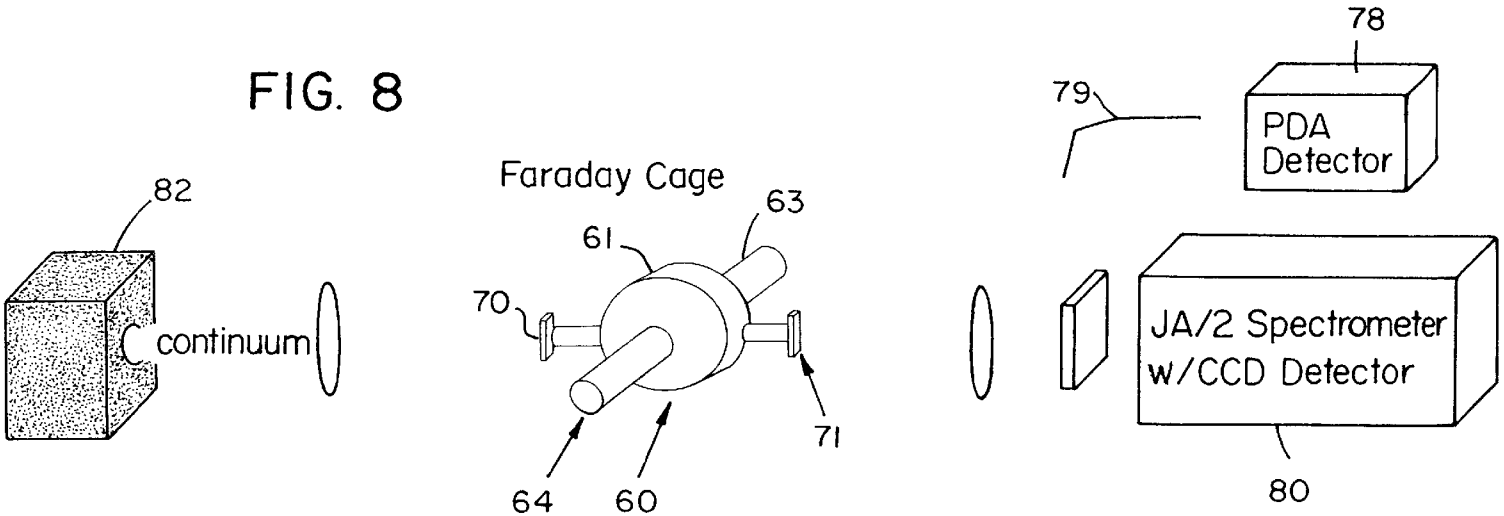
FIG. 8 is a simplified diagram illustrating the use of the device of FIG. 5 for carrying out absorption measurements.

Two kinds of measurements may be made utilizing the arrangement illustrated in FIG. 8. The first measurement requires adequate access to the plasma emission and, e.g., a spectrometer with a photodiode array (PDA) detector. The PDA 78 is a detector with, e.g., 1024 small photodiodes made of light sensitive material, aligned in a row. The advantage of the PDA is that it measures a broad width of the spectrum at one time. A fiber optic cable 79 may be used to transfer light from the cell 61 to a PDA-equipped spectrometer. Another spectrometer 80 with a charged-coupled device (CCD) detector may then be mounted permanently in front of the cell's emission. The CCD detector allows for both 1-D and 2-D resolution because of its planar array design. The CCD's sensitivity is much higher, which allows for more sensitive absorption measurements. Another necessary component of an absorption setup is the continuum source 82, e.g., a xenon arc lamp, which provides a fairly smooth continuous spectrum across a wide wavelength range.

The RF discharge cell 61 is normally connected to vacuum to prevent oxidation of barium. Helium, neon, argon, krypton, and xenon can be added to the system relatively easily. The noble gases serve several functions. First, the plasma may be started at room temperature as a noble gas discharge. This initial discharge heats up the barium. The substantial barium vapor pressure alters the characteristics of the noble gas discharge gradually. Second, the noble gas acts as a buffer gas when the barium vapor takes over the discharge.

The absorption method is a convenient way of measuring the density of atoms in a glow discharge. There are several key concepts involved in making an absorption measurement and determining the density. First, absorption, as an atomic process, is the opposite of emission. Emission is the process by which an excited electron "falls" to a lower state, thereby releasing a photon of energy. Absorption, on the other hand, occurs when a photon excites an atom to a higher state. A continuum source provides a wide range of photon wavelengths. Experimentally, we determine the transmission or absorption spectrum by:

$$T = \frac{S_{emission+continuum} - S_{emission}}{S_{continuum}}$$

Figure 9:
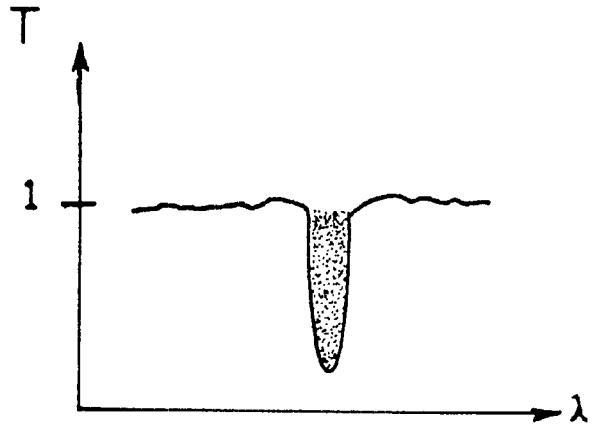
FIG. 9 is a simplified plot for illustrative purposes of wavelength versus transmission, of the type that may be obtained utilizing the apparatus of FIG. 8.

The second key concept is equivalent width. Equivalent width is the integrated area of an absorption feature, as illustrated in FIG. 9. Experimentally, this quantity is relatively easy to determine. The transmission can be plotted as a function of wavelength, and the area of an absorption feature can be found.

Theoretically, the equivalent width is a more complicated concept. The equivalent width can be found as a function of column density, a relationship called the curve of growth. Once the experimental equivalent width is known, the curve of growth allows the corresponding column density to be read. To generate the curve of growth, one starts with the general equation for the equivalent width (T is transmission and ν is the frequency):

$$W_\nu = \int_{-\infty}^{\infty} (1-T)\,d\nu$$

Transmission is related to the density by the following equation:

$$T = e^{-\sigma NL};\ \sigma = \pi r_e c f g(\nu - \nu_o)$$

where:

$r_e$ is the classical electron radius;

$f$ is the absorption oscillator strength;

c is the speed of light;

$g(\nu-\nu_o)$ is the normalized lineslope; and

σ is the absorption cross section.

Figure 10:
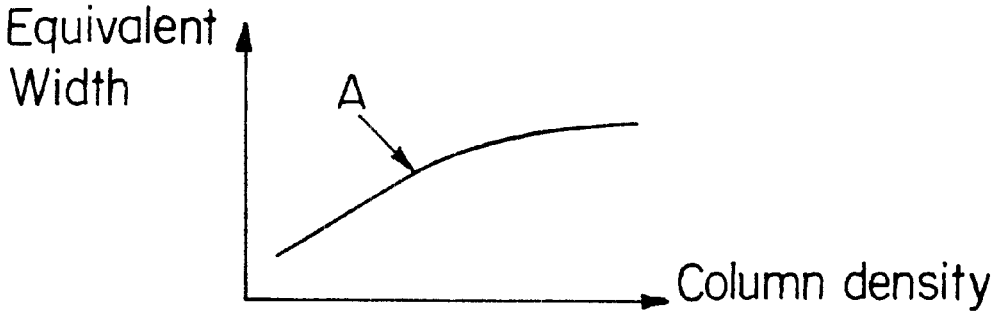
FIG. 10 is a simplified plot of equivalent width versus column density.

The factor of $g(\nu-\nu_o)$ is typically a Voigt profile, and for the present conditions is a function of both the atomic and plasma physics. Although atomic transitions are said to be at a specific wavelength, the uncertainty principle and other effects will broaden out the wavelength range. This explains the bell-shaped curve that is associated with an atomic transition from emission or absorption. These equations allow the curve of growth to be generated, as shown for illustration in FIG. 10.

The last important concept is optical thickness. Optical thickness is a frequency and density dependent quantity that indicates the effective depth within the sample from which most of the light is emitted. An optically thin source is a gas discharge whose intensity is proportional to the density of excited atoms. As the name suggests, the absorption of continuum light by such a discharge would be small. On the other hand, an optically thick source has a very high absorption. This situation is undesirable for accurate absorption measurements because it is on the saturated portion of the curve of growth, which corresponds to the flat area in FIG. 10 to the right of the point marked A. The emission line shape of the spectral line also changes, characterized by broad wings, which coincides with a broader absorption profile, therefore increasing the influence of the wings on the experimentally calculated equivalent width. Small changes in equivalent width correlate with large changes in column density in an optically thick source. Therefore, accuracy of column density from an absorption measurement will be better if the sample is not extremely thick.

Figure 11:
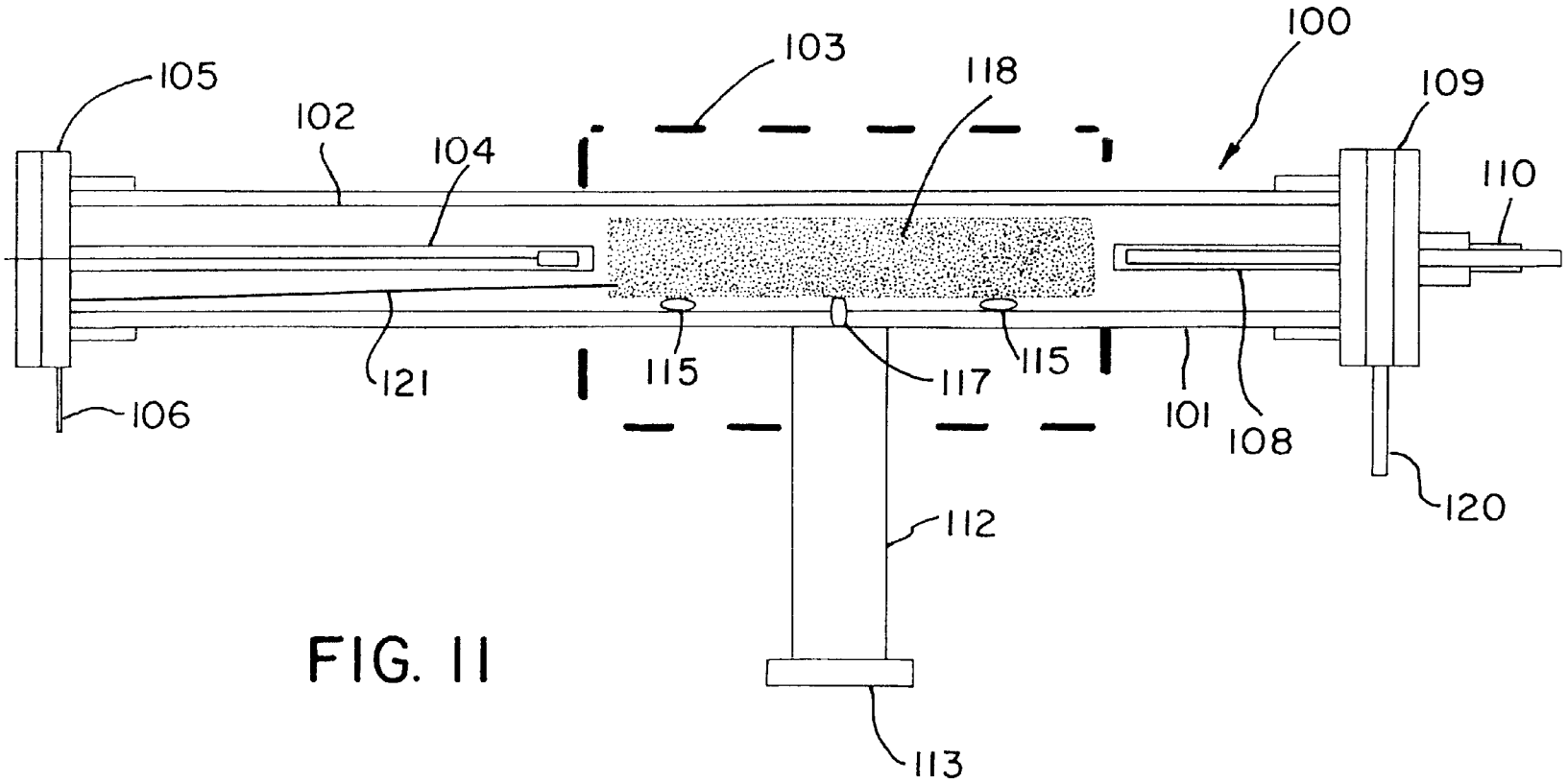
FIG. 11 is a simplified diagram of another improved discharge device in accordance with the invention.

A further discharge apparatus design as shown at 100 in FIG. 11 has an outer quartz tube 101, an inner fused silica liner 102, a clam shell oven 103, a cathode electrode 104 with cathode end plate 105 and cathode feedthrough 106, an anode electrode 108 with an anode end plate 109 and an anode feedthrough 110, and a quartz tee arm 112 with a fused silica window 113. Barium chunks 115 are mounted within the liner 102, and a hole 117 in the liner provides access to the barium positive column 118. A few grams of barium are preferably placed along the bottom of the discharge tube, in the form of 4 or 5 small pieces 115 spaced along the length of the tube between the anode and cathode. A tube 120 extends to a pump (not shown) for evacuation of the interior of the discharge apparatus. The fused silica window 113 on the side arm 112 was sealed with TorrSeal epoxy.

Fused silica is quickly blackened to complete opacity by barium vapor at temperatures as low as 500° C., so to maintain optical access to the discharge positive column a small oblong hole 117 (approximately 0.15 cm×1.0 cm) is cut into the wall of the quartz liner. This hole 117 is centered in the view port. The fused silica window 113 at the end of the view port extends well outside the hot zone of the oven so that any barium vapor will condense out on the side walls of the arm before reaching the window.

The cathode consists of a short length of stainless steel tubing spot-welded to stainless steel wire which connected to a vacuum power feedthrough at the flange 105. Both the cathode wire and the hollow cathode itself are shielded from the metal wick with quartz tubing. The anode consists of a ⅛" stainless steel rod, shielded by a ¼" OD fused silica tube which enters the vacuum region through an O-ring sealed Cajon fitting. The anode-to-cathode distance may be adjusted by moving the anode in and out of the discharge. A floating probe 121 is incorporated that extends past the cathode into the low-voltage end of the positive column.

The active discharge area between the electrodes is enclosed within the oven 103. The temperature can be measured in the center of the oven; the oven temperature does not equal the cold spot temperature, which will be somewhat lower by at least several 10 s of degrees C. Thus, experimental temperatures represent upper limits for the cold spot temperatures. A K-type (chromel-alumel) thermocouple may be used to measure the oven temperature.

Figures 12, 13:
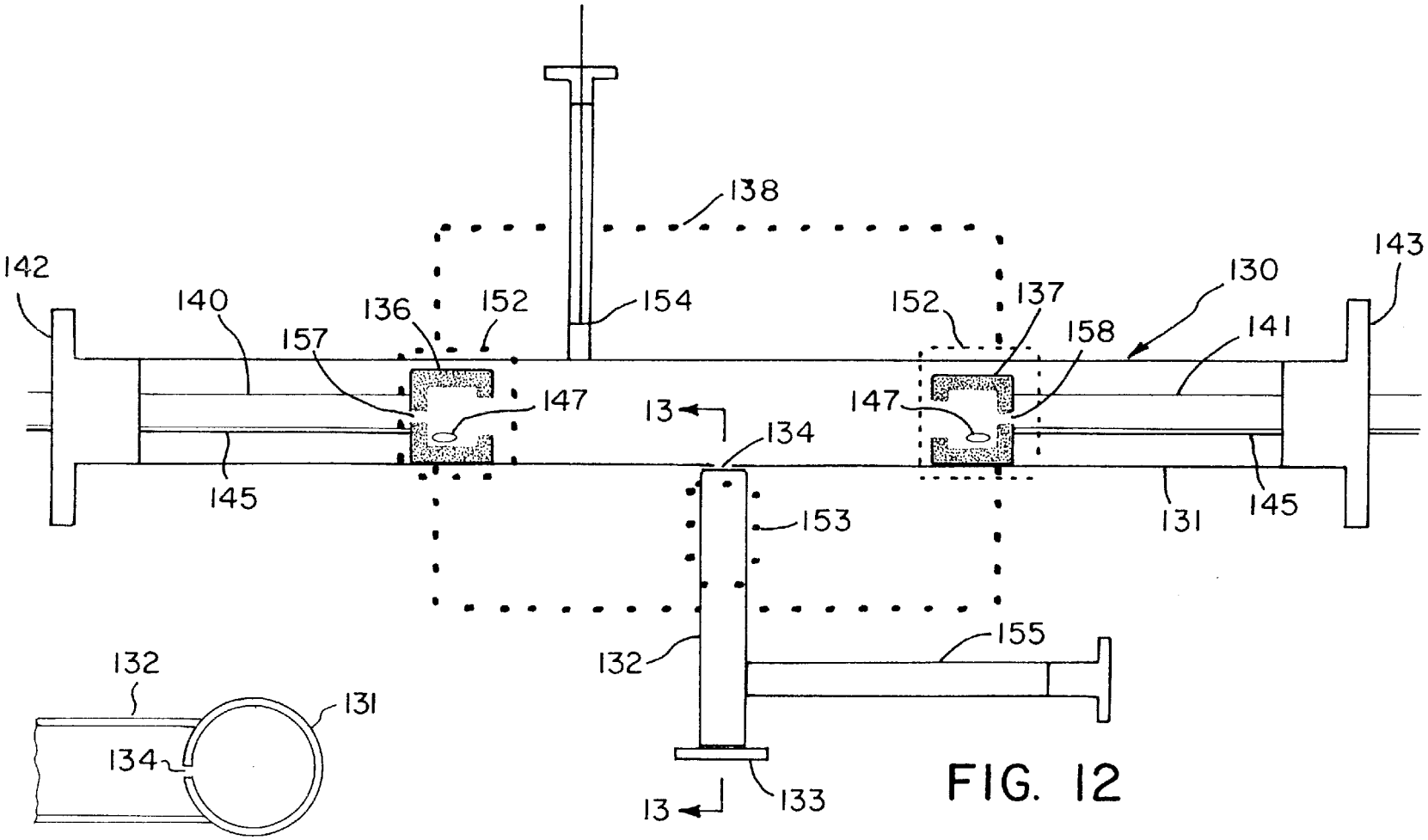
FIG. 12 is a simplified diagram of another improved discharge device in accordance with the invention having cup electrodes.
FIG. 13 is a simplified cross-section taken along the lines 13—13 of FIG. 12, showing the joining of the side arm to the main discharge tube in the apparatus of FIG. 12.
Figure 14:
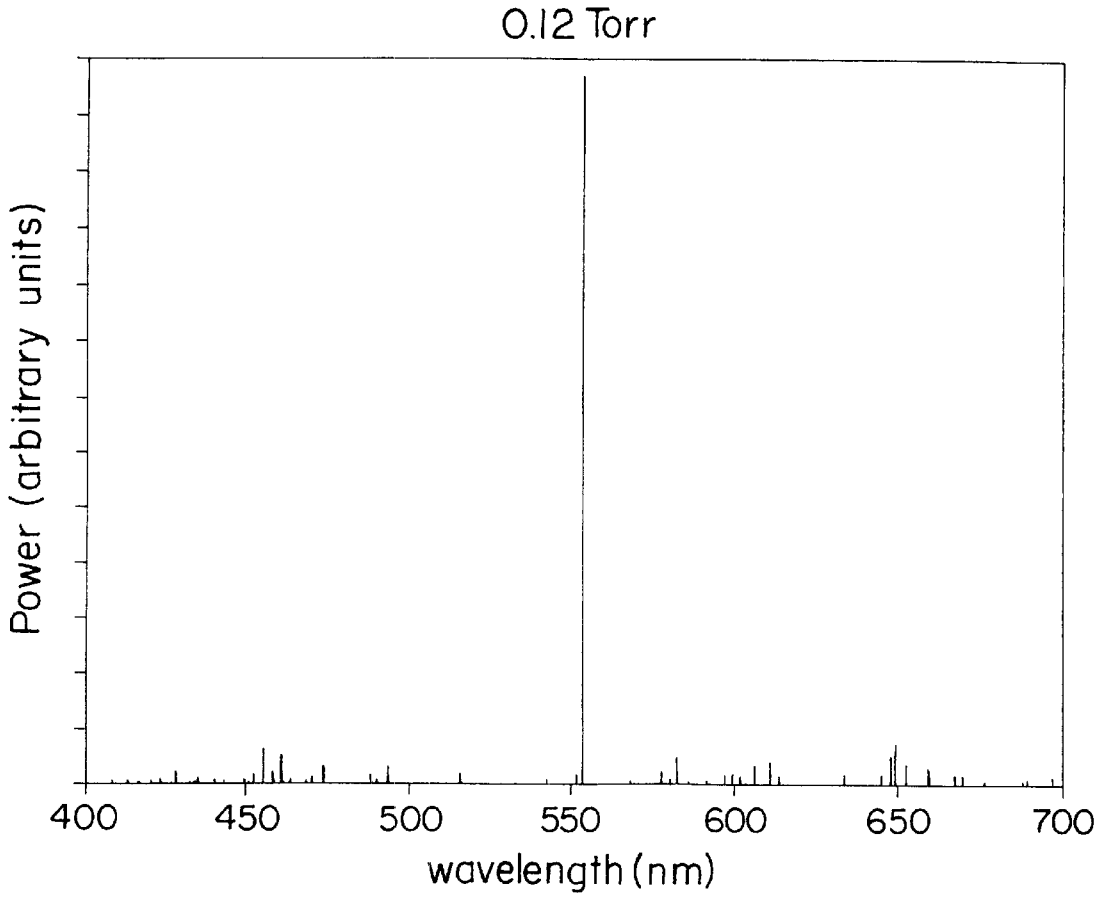
FIG. 14 is a diagram of barium discharge emission spectra at a temperature of 675° C. and a partial argon pressure $P_{Ar}$=0.12 Torr.
Figure 15:
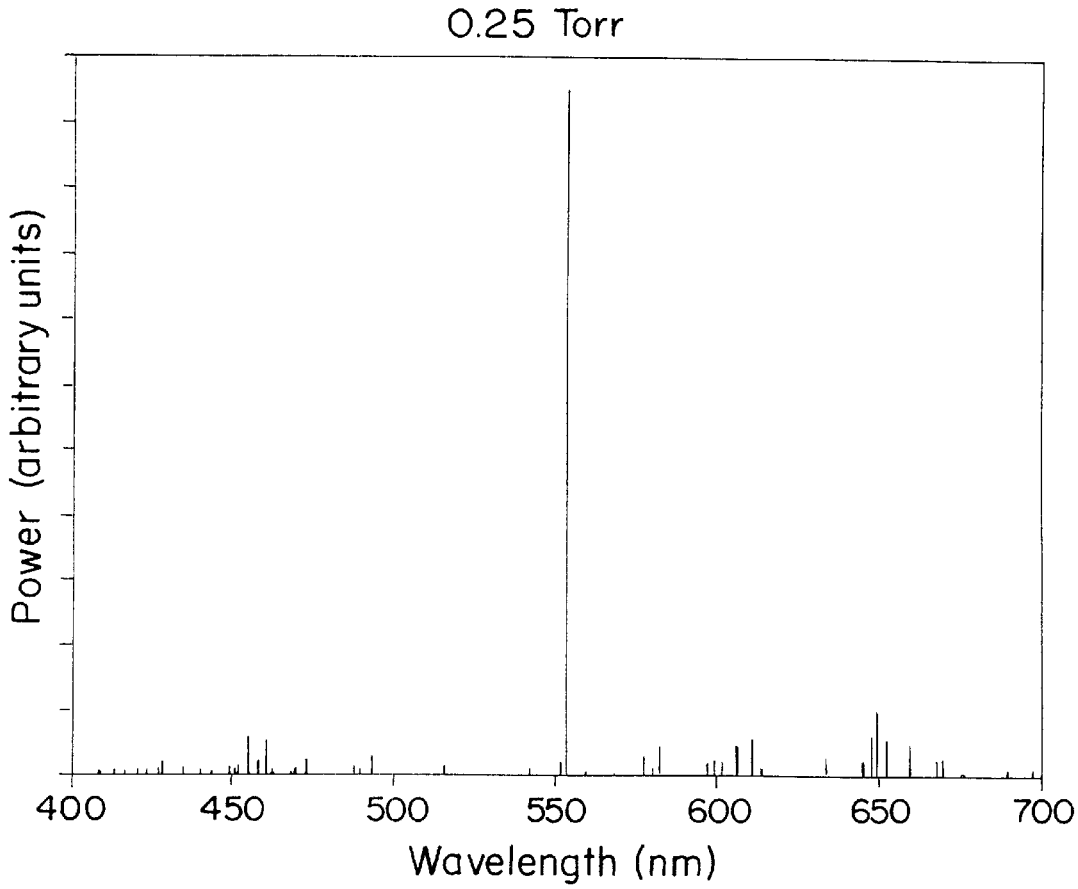
FIG. 15 is a diagram of barium discharge emission spectra at 675° C. and $P_{Ar}$=0.25 Torr.
Figure 16:
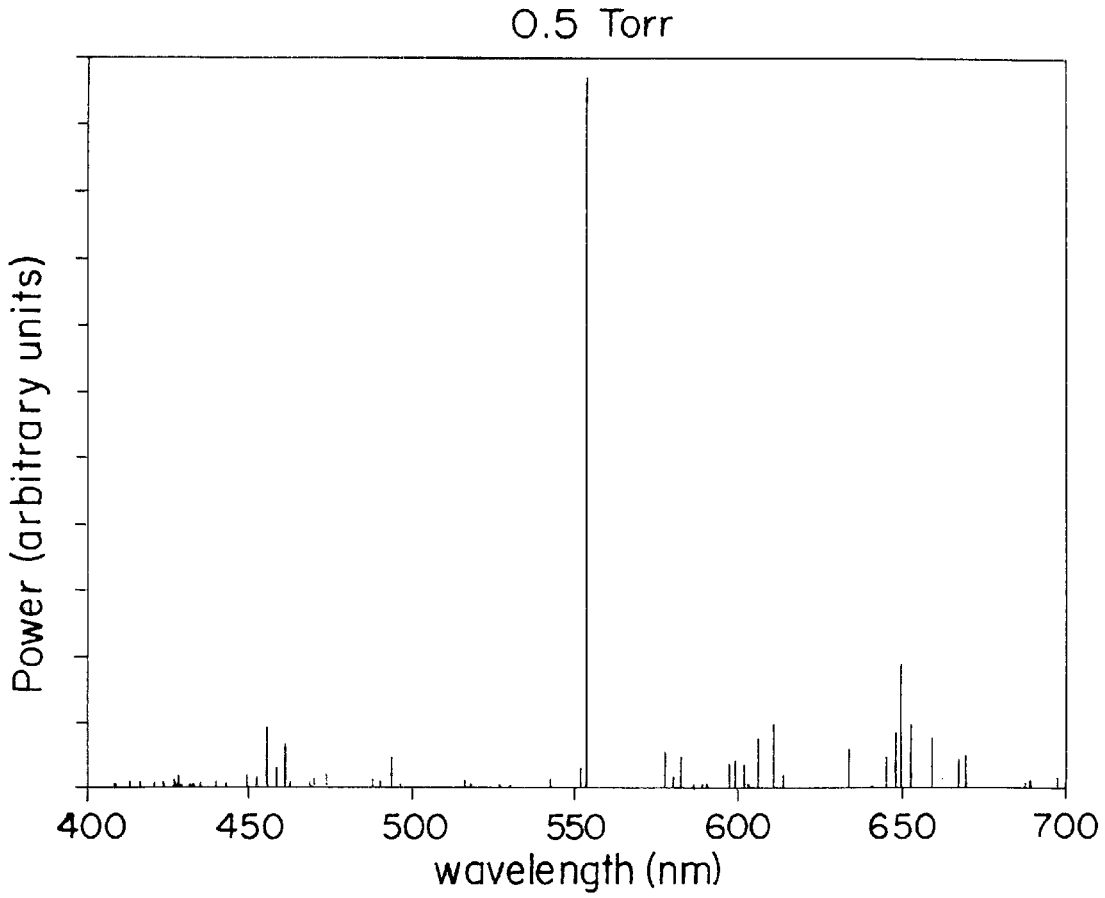
FIG. 16 is a diagram of barium discharge emission spectra at 675° C. and $P_{AR}$=0.5 Torr.
Figure 17:
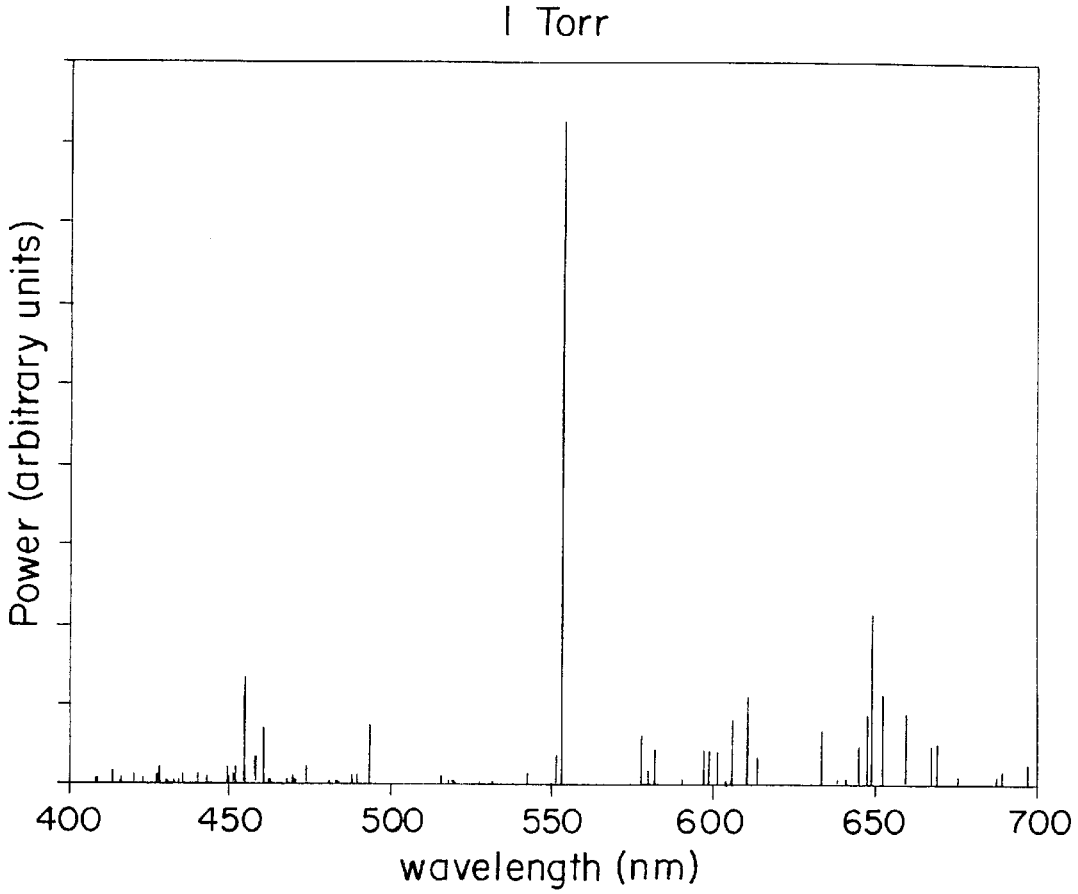
FIG. 17 is a diagram of barium discharge emission spectra at 675° C. and $P_{Ar}$=1 Torr.
Figure 18:
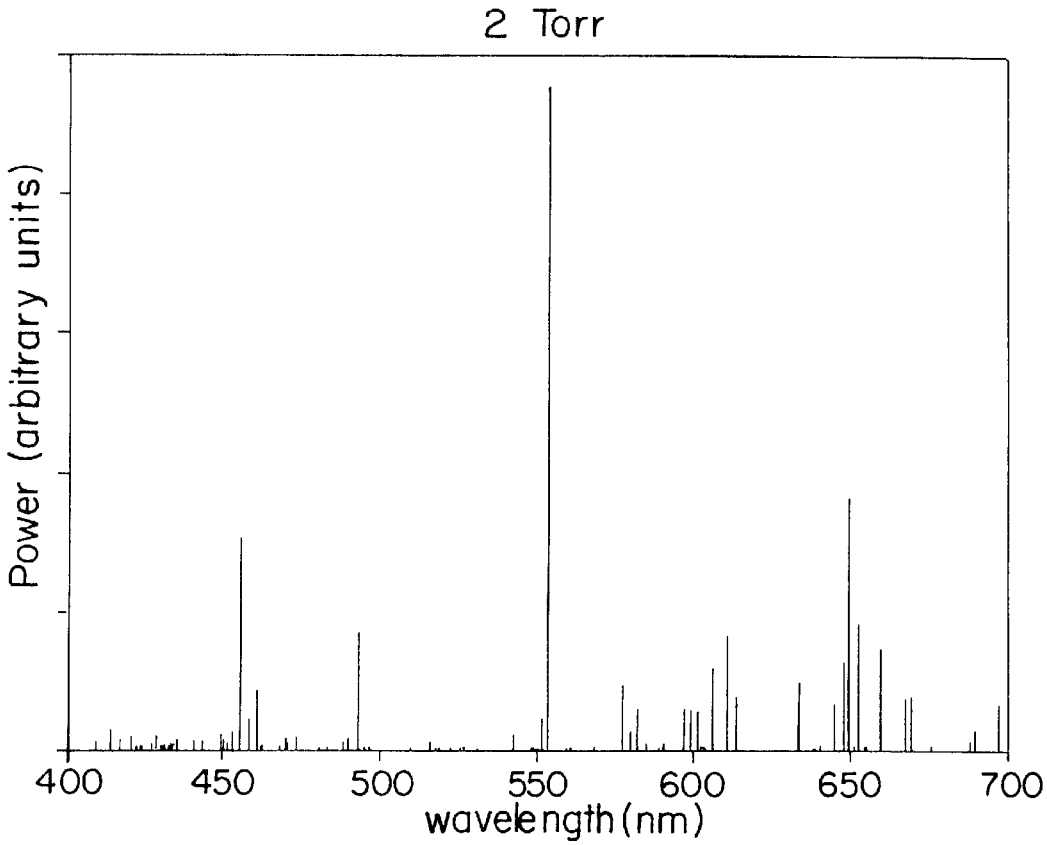
FIG. 18 is a diagram of barium discharge emission spectra at 675° C. and $P_{Ar}$=2 Torr.
Figure 19:
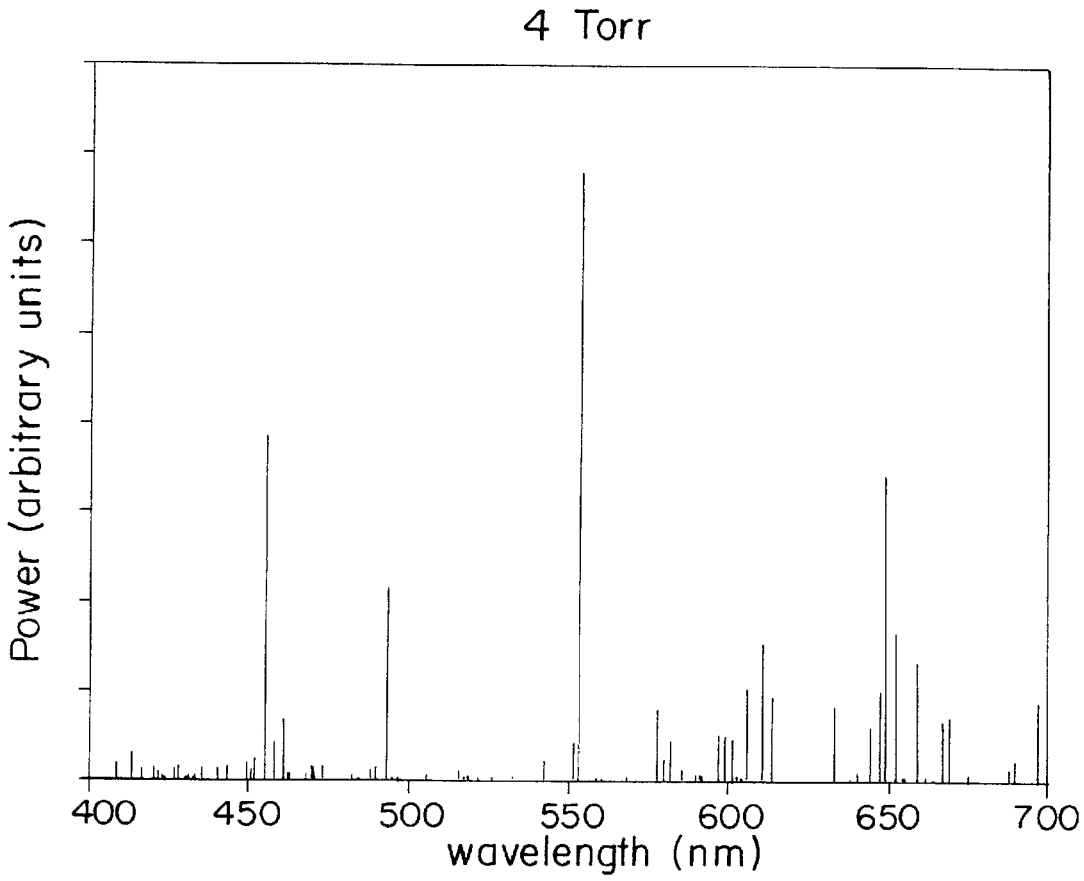
FIG. 19 is a diagram of barium discharge emission spectra at 675° C. and $P_{Ar}$=4 Torr.
Figure 20:
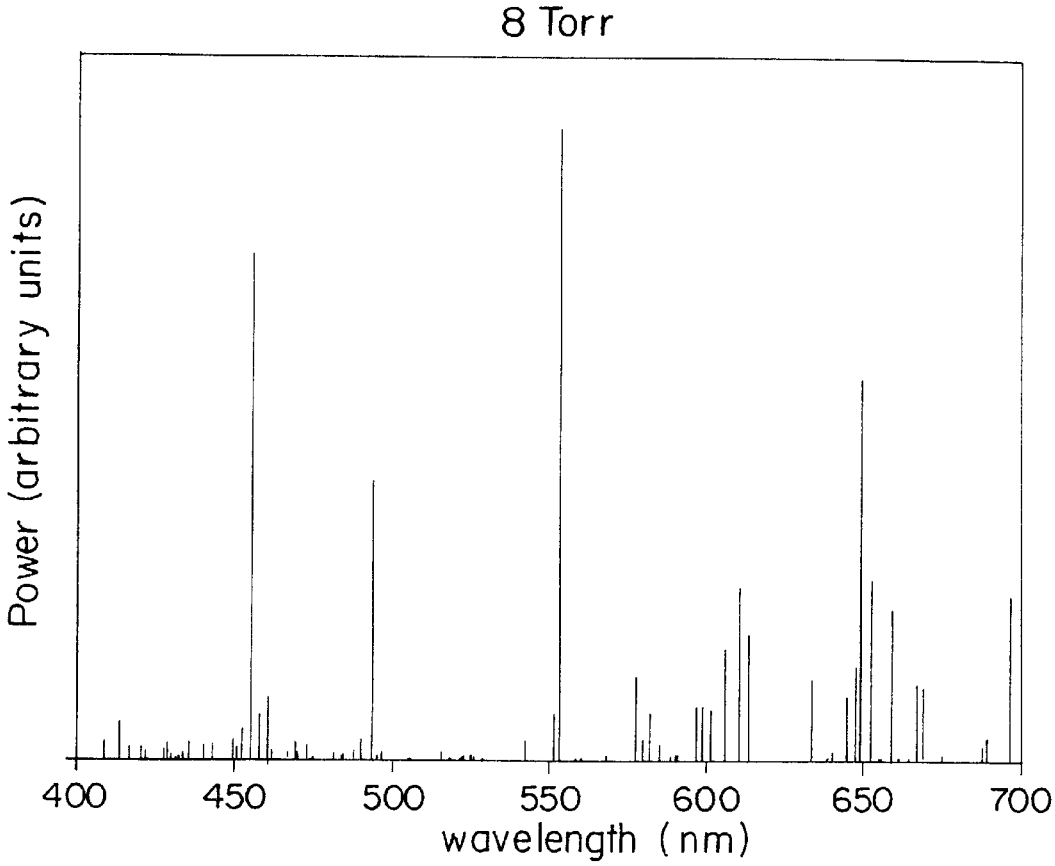
FIG. 20 is a diagram of barium discharge emission spectra at 675° C. and $P_{Ar}$=8 Torr.

FIG. 12 illustrates another design 130 for the discharge apparatus. It consists of a single fused silica manifold 131 with a side arm 132 closed by a fused silica window 133. A small (2 mm diameter) hole 134 is cut in the main tube, centered on the side arm 132, as also illustrated in the cross-sectional view of FIG. 13. The electrodes 136 and 137 are in the form of cups of stainless steel which sit entirely inside the oven 138, with thin wire (1 mm diameter) electrical connections 140 and 141 extending out to the feedthroughs at the flanges 142 and 143. The electrode wires are shielded with narrow fused silica tubing. A thermocouple 145 is connected directly to each electrode and the barium dose 147 is placed in the cup of the electrode, and the thermocouple wires are shielded with ceramic beads. Band heaters 152 for the electrode regions, set-point controlled with respect to the electrode temperature, are preferably used so that the cold spot temperature could be directly controlled. In addition to the clam shell oven, which may now be set a few 10 s of degrees C. higher than the cold spot to insure that the barium vapor condenses only on the electrode, an additional heater 153 may be used. This heater may be formed of resistive tape wrapped around the side arm to pre-heat the incoming flow of buffer gas so that it entered the discharge region at higher than room temperature. A voltage probe 154 is fused directly into the side of the discharge tube, to prevent possible shorting out of the cathode to the probe.

The buffer gas flows in from a tube 155 through the side arm 132 and out past the cathode 136, which is at a high voltage. The cathode cup has a small (1 mm diameter) hole 157 in the back for pumping. The anode also has a hole 158 for pumping which is slightly bigger (2 mm diameter), to use during pump-out and bake-out of the system. Both ends of the discharge tube are connected to the pumping chamber. During operation, however, the anode end of the tube is valved off so that a pressure reading can be made at a point where there is no pressure gradient.

The color of the discharge can be tuned continuously from a bright green color, to white, to a pinkish white color, by altering the buffer gas pressure or the discharge power or both. FIGS. 14–20 are emission spectra, showing relative power versus wavelength, for a range of buffer gas pressures. It is understood that higher gas pressures may be utilized, if desired. As illustrated by these figures, as the buffer gas pressure was increased, the intensity of the green line decreased, and the contribution from spectral lines throughout the rest of the visible spectrum increased. Most notable are four strongly radiating lines, two in the blue and two in the red, that are due to the barium ion ($Ba^+$). Barium and other alkaline earth metals have strong ion resonance lines in the visible. With the red-green-blue character of the emission spectrum, this light appeared white to the eye. In addition, most of the remaining spectral contribution came from a number of red lines, giving "warmth" to the appearance of the light, which people tend to prefer (a common complaint about many fluorescent lamp phosphors, for example, is the harshness caused by the disproportionate blue component).

Figure 21:
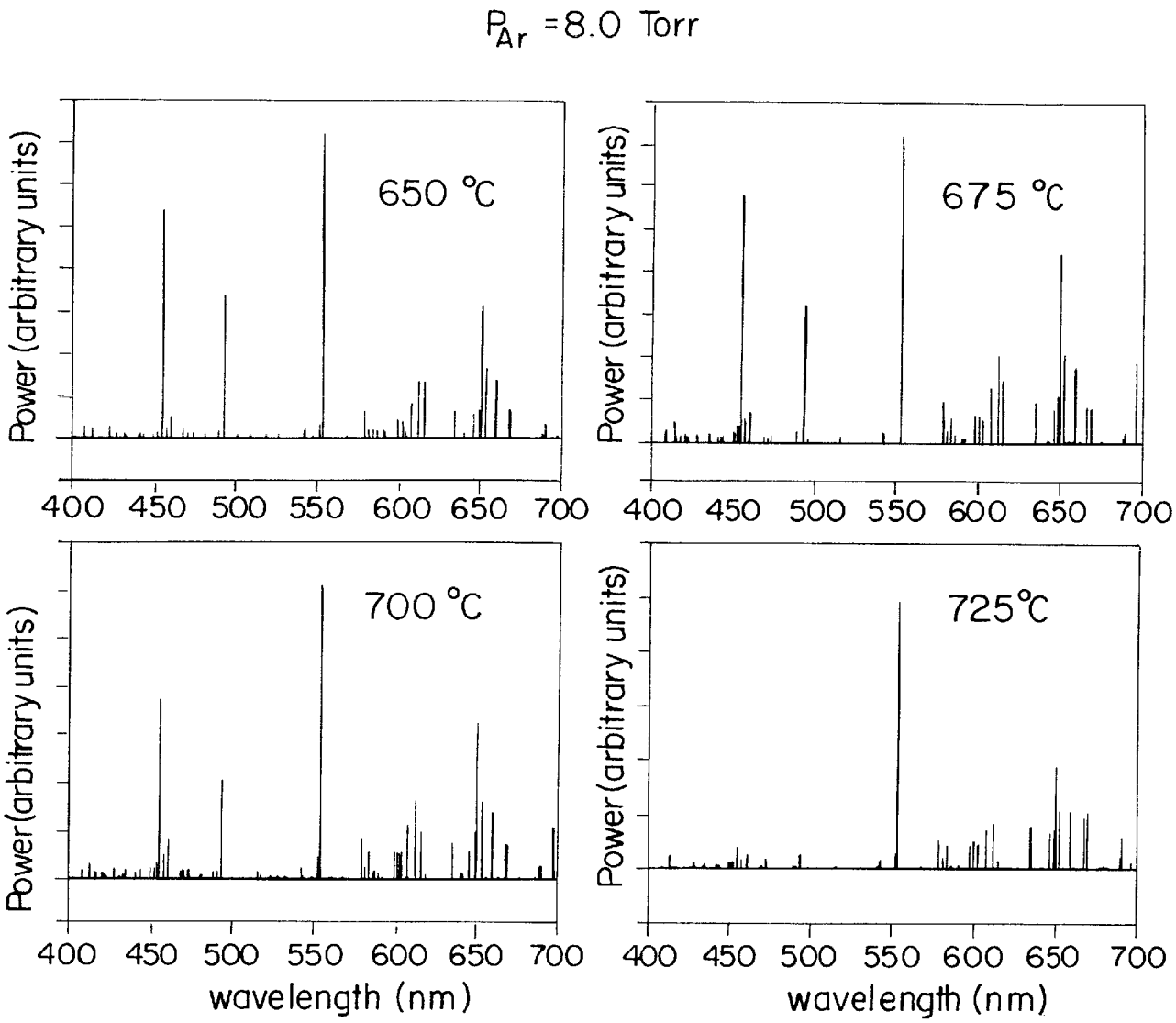
FIG. 21 are emission spectra for barium discharges at a constant argon pressure $P_{Ar}$=8 Torr showing the emission spectra at temperatures of 650° C., 675° C., 700° C., and 725° C.
Figure 22:
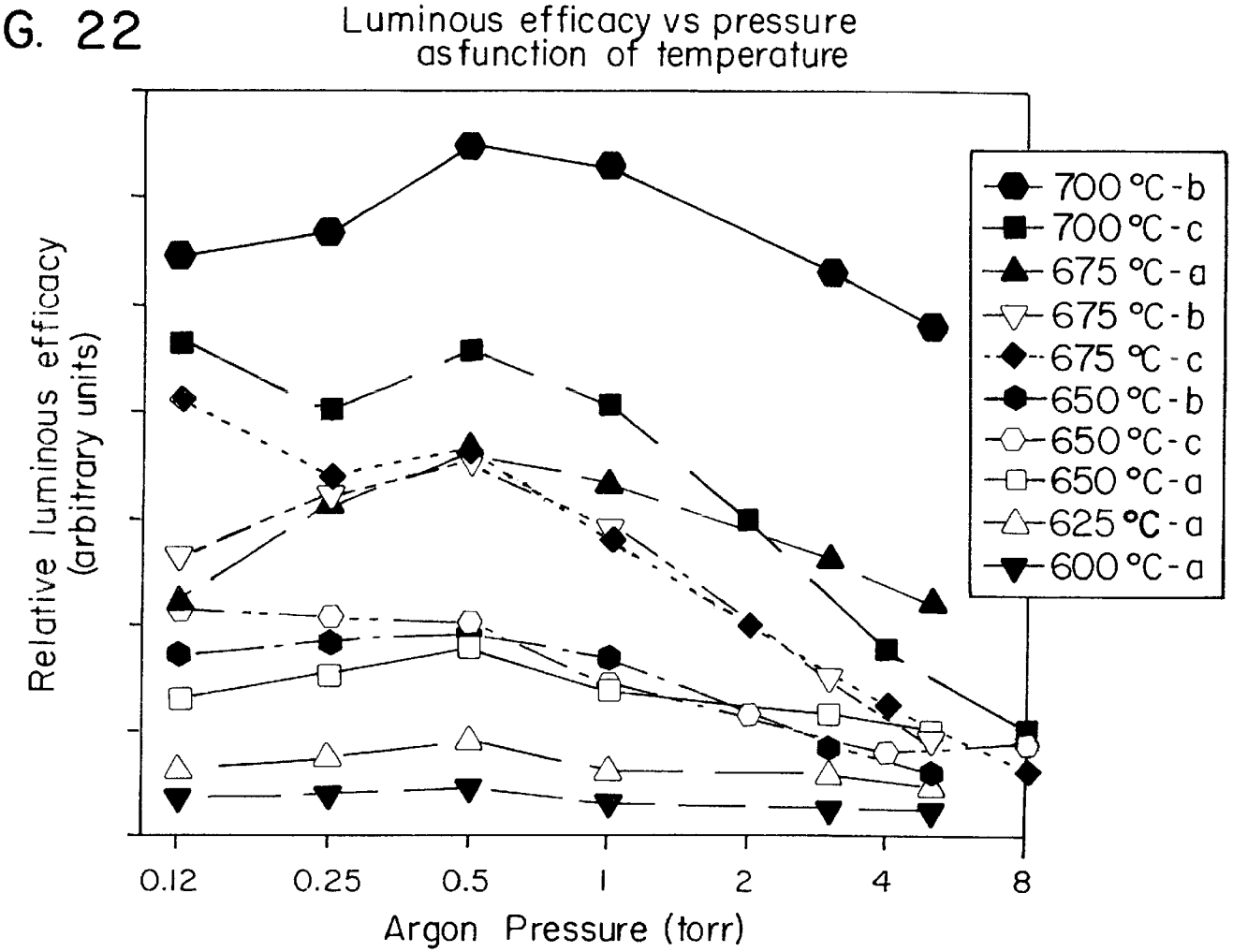
FIG. 22 are graphs showing the relative efficacy of barium discharge as a function of buffer gas pressure.
Figure 23:
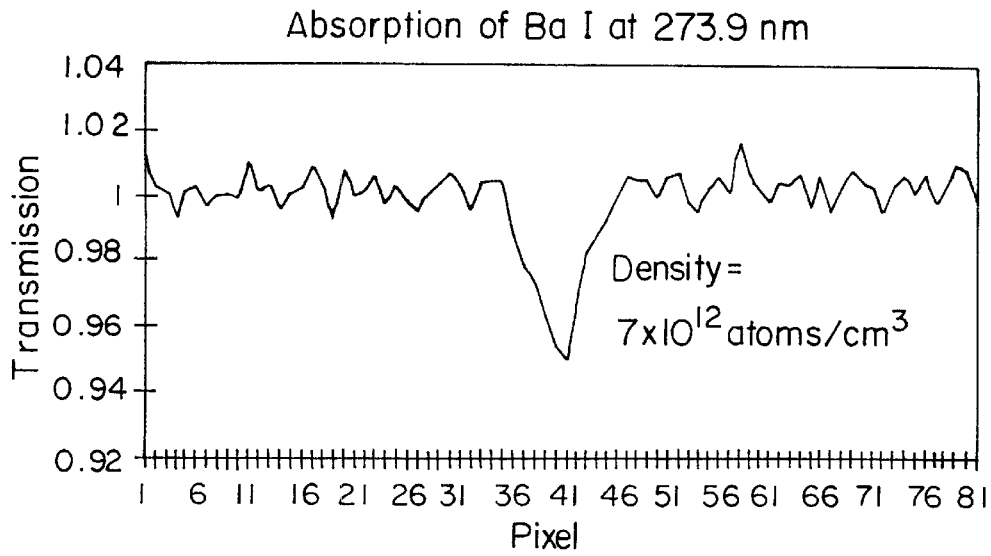
FIG. 23 is a plot of absorption of Ba I (neutral barium) at 273.9 nm.
Figure 24:
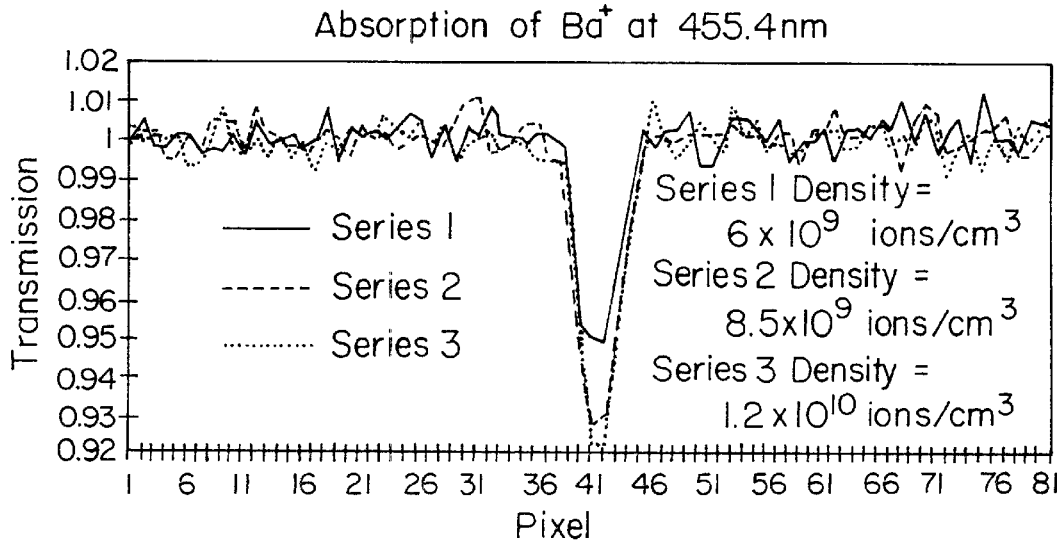
FIG. 24 is a plot of absorption of Ba II ($Ba^+$) at 455.4 nm.

The trends in discharge color noted above hold true for a range of oven temperatures from 600° C. to 700° C. Below 600° C., there is not enough Ba in the vapor phase to strike a Ba discharge, and the appearance is nearly that of an Ar discharge. Above 700° C., the ion lines disappear, and a yellowish-green discharge containing only Ba neutral lines remains. FIG. 21 compares the emission spectra for discharges with an argon pressure of 8 Torr and a range of temperatures that extends from below to above 700° C. FIG. 22 illustrates the relative efficacy of the positive column discharge as a function of buffer gas pressure and oven temperature.

The light from a Ba discharge contains line emissions only, not a continuum, and, thus, the color rendering properties of the light will not approach that of an incandescent, fluorescent or even an HID lamp. It will, however, be better than that of a high or low pressure sodium lamp or a high pressure mercury lamp.

The first measurements made on the barium RF discharge were emission spectra. Two distinct types of discharges were noted, an E-mode and an H-mode. The E-mode, or capacitive mode, appears at low RF power and maintains the discharge through an axial electrostatic field. The H-mode, or inductive mode, occurs when the coil current is sufficient enough to induce an azimuthal electric field. Higher powers and better power coupling characterize this mode of operation.

Figure 29:
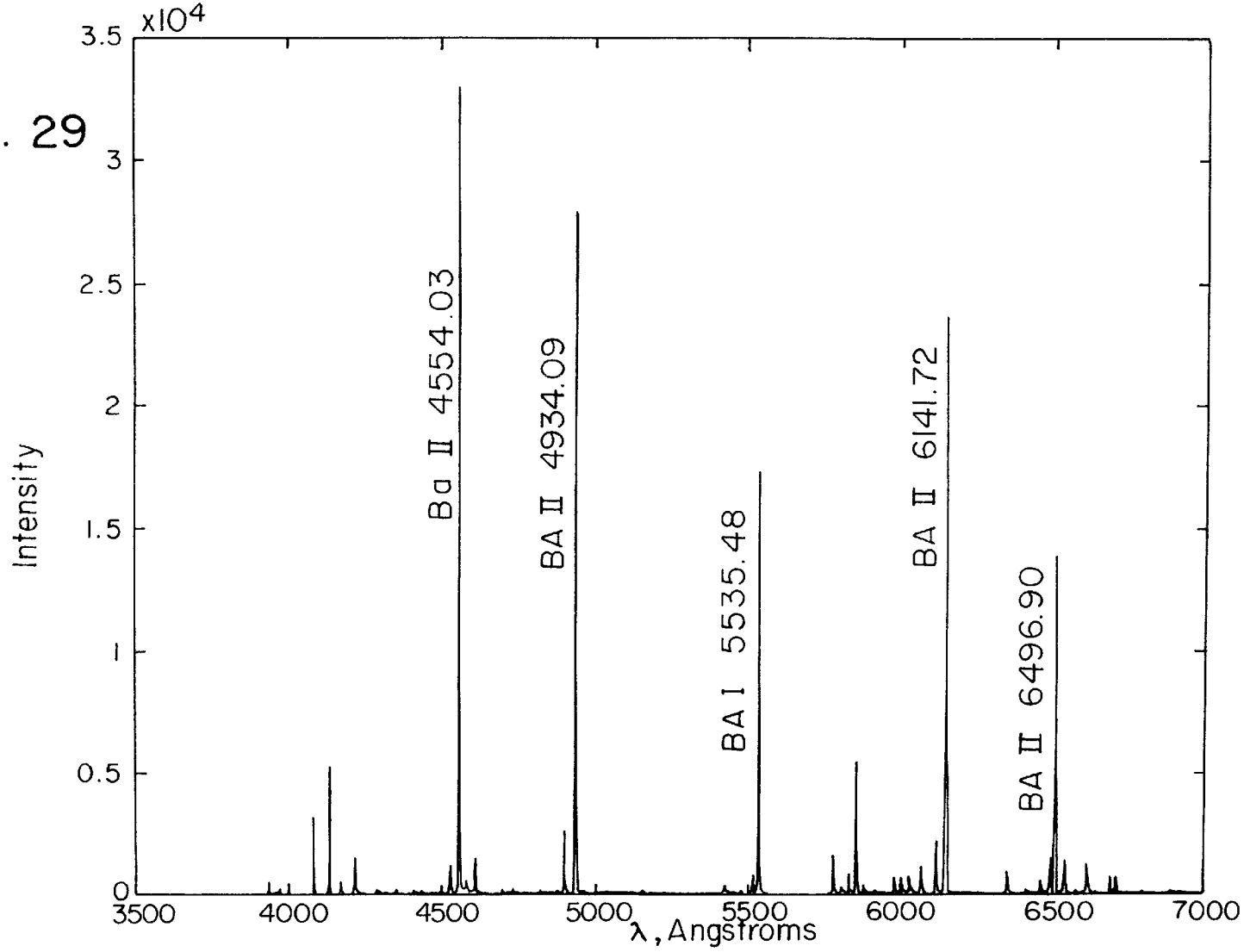
FIG. 29 are plots showing the spectrum of emission lines from various barium levels and barium ion levels.
Figure 30:
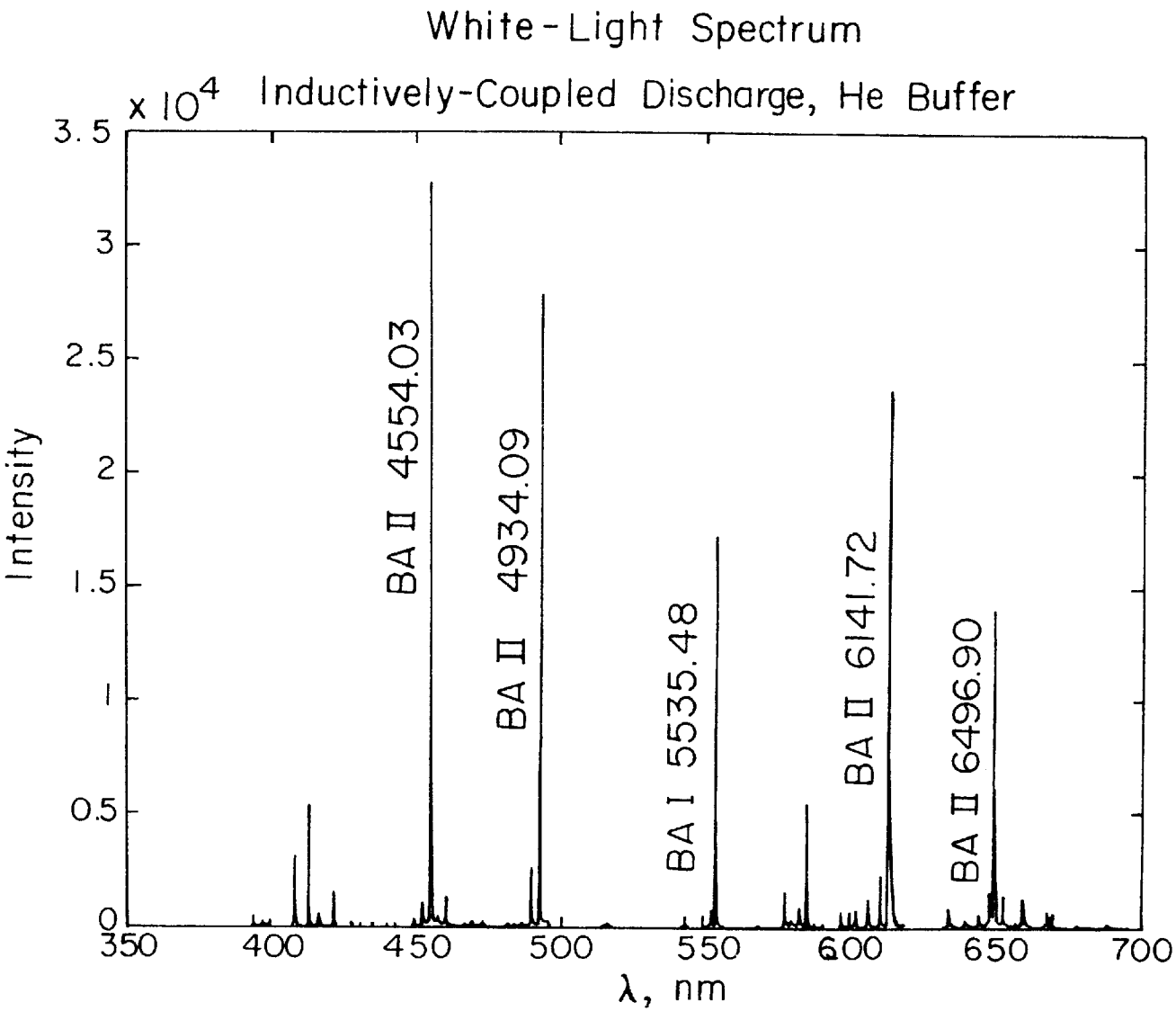
FIG. 30 are graphs showing spectral emission lines for an inductively coupled Ba discharge using a helium fill gas illustrating the generation of an effective white light spectrum.
Figure 31:
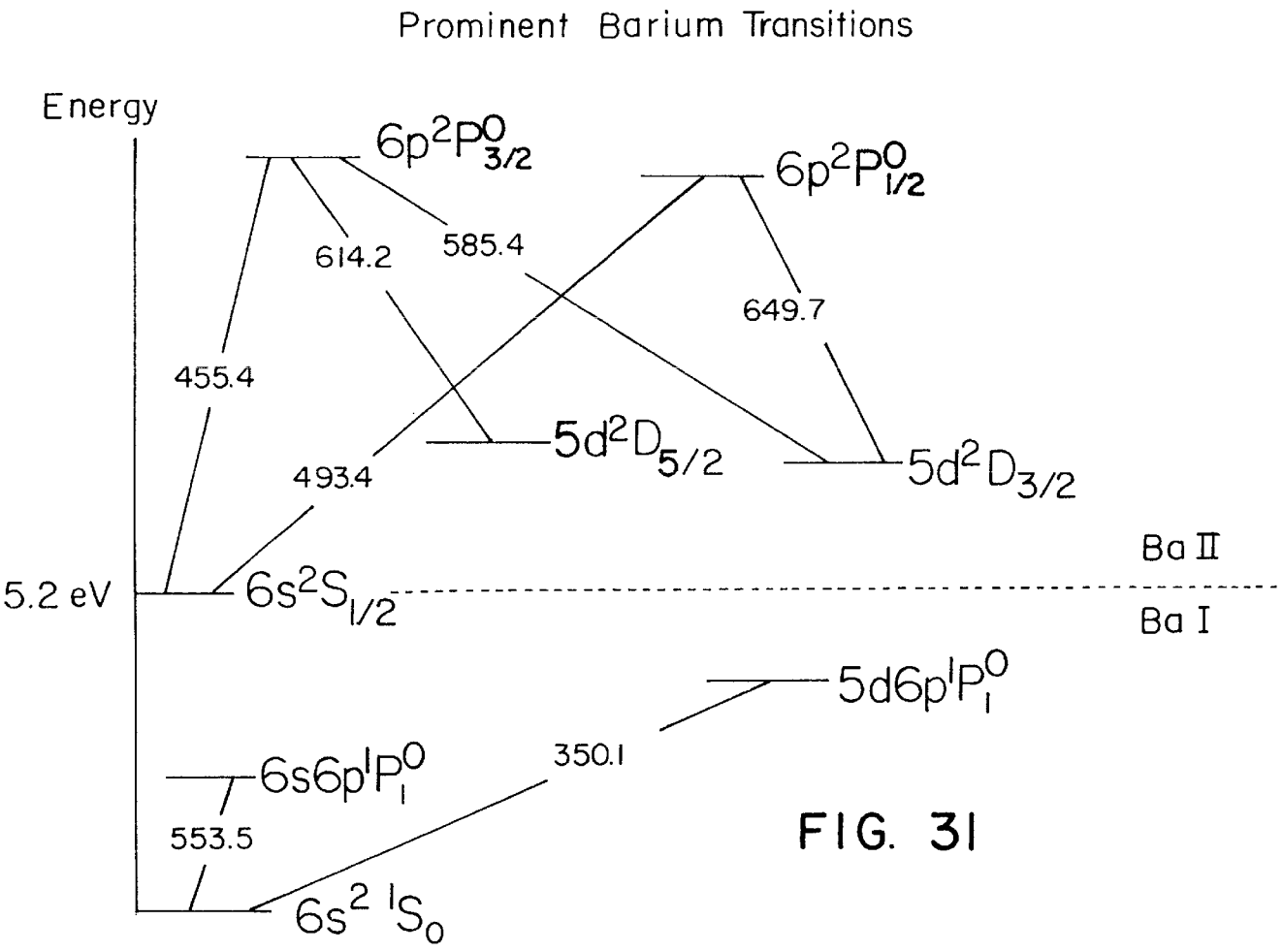
FIG. 31 is a diagram illustrating prominent barium and barium ion transitions.
Figure 32:
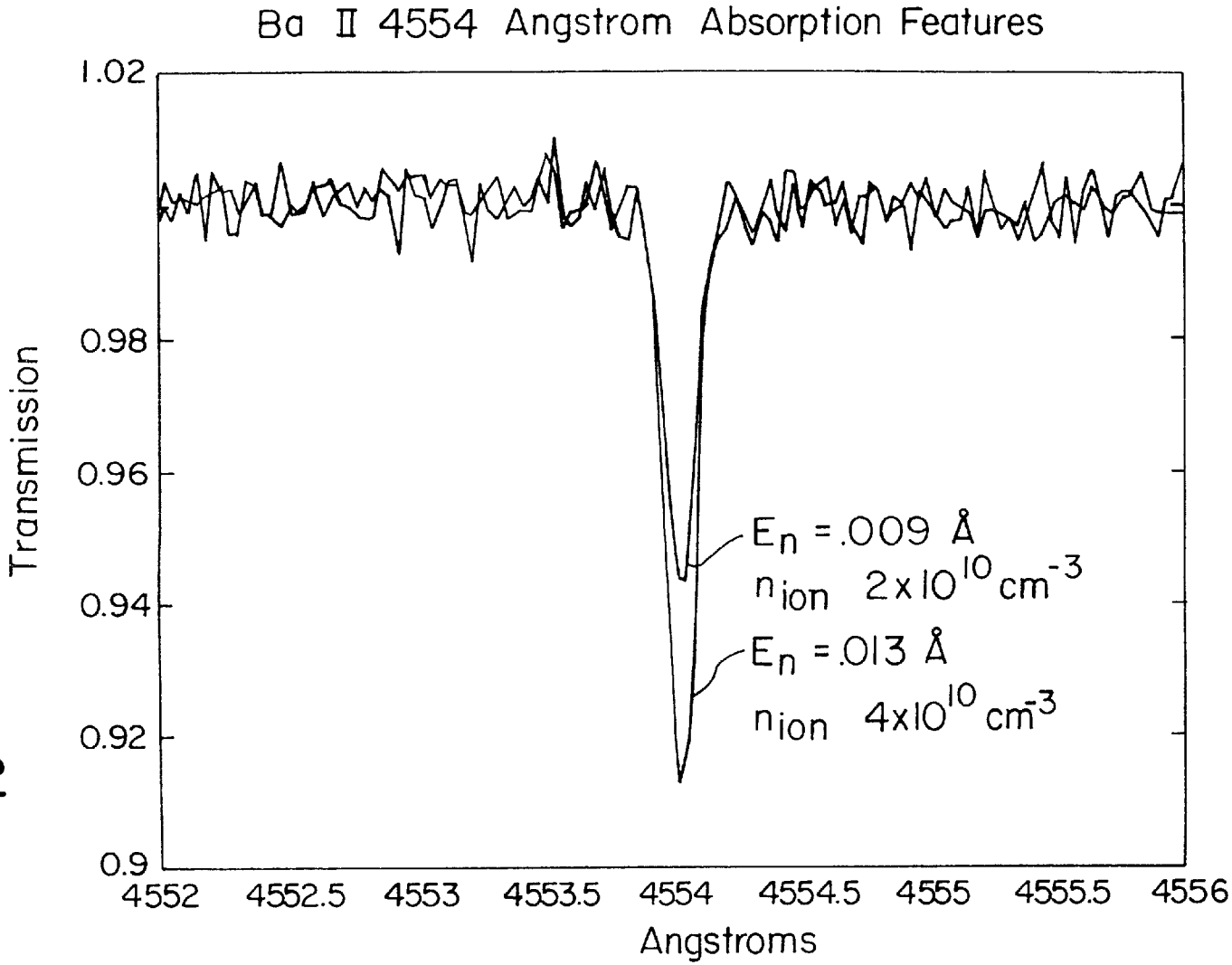
FIG. 32 is a graph illustrating Ba II at 4554 Angstroms absorption features.

FIG. 29 is a spectrum from a typical H-mode discharge. The centerline is the excited state transition at 553.5 nm. The strong pairs of lines lower and higher in wavelength are ion transitions. The prominent transitions can be read from left to right: Ba II 4554.03 Å, Ba II 4934.09 Å, Ba I 5535.48 Å, Ba II 6141.72 Å, Ba II 6496.90 Å. The combined light output is white, with varying shades depending on ratios of ion spectral lines. Another convincing factor that we had established in a barium discharge is that all of the other smaller lines were conclusively identified as barium transitions.

Figure 27:
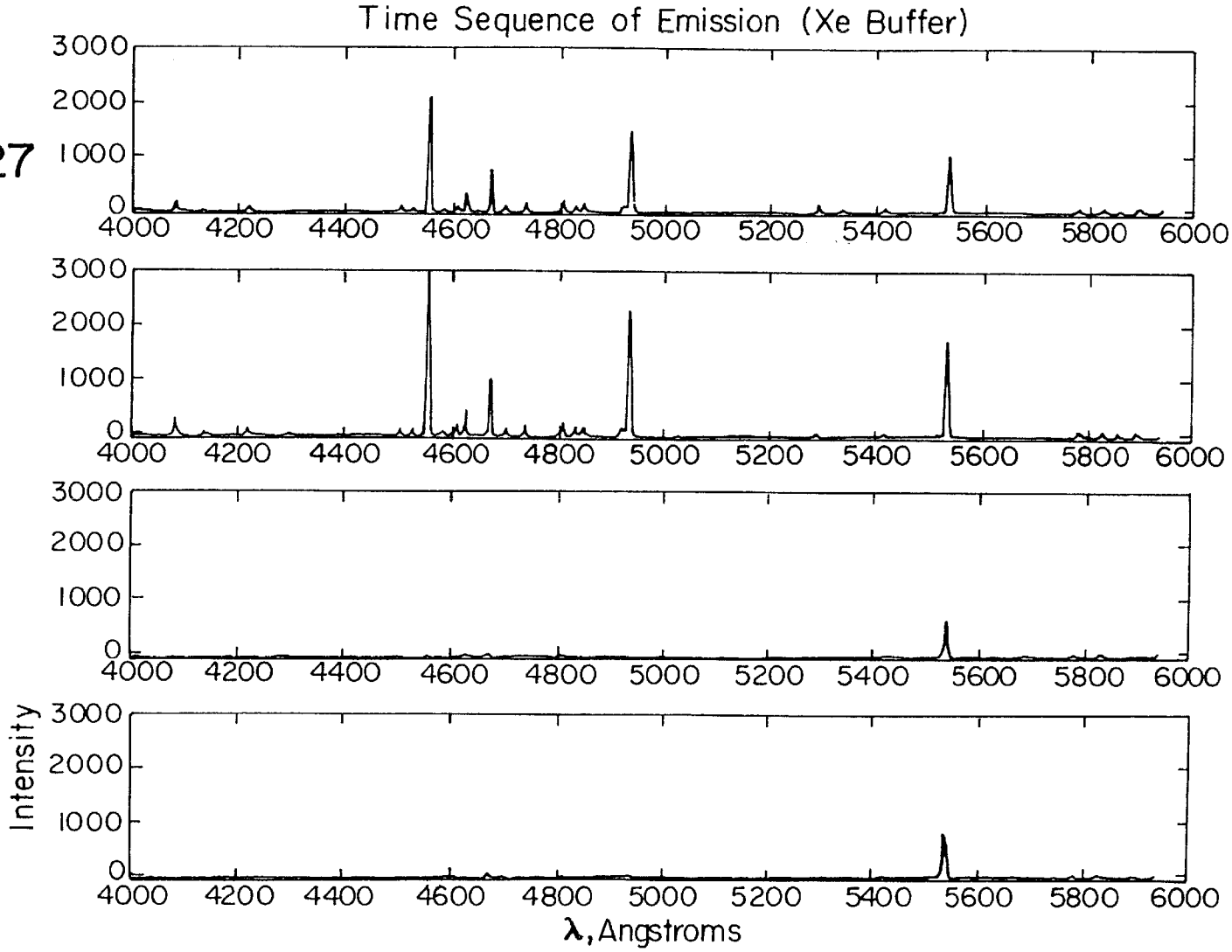
FIG. 27 are a series of graphs illustrating the time sequence of 15 emission with a Xe buffer for the E-H mode transition for the barium discharge.
Figure 28:
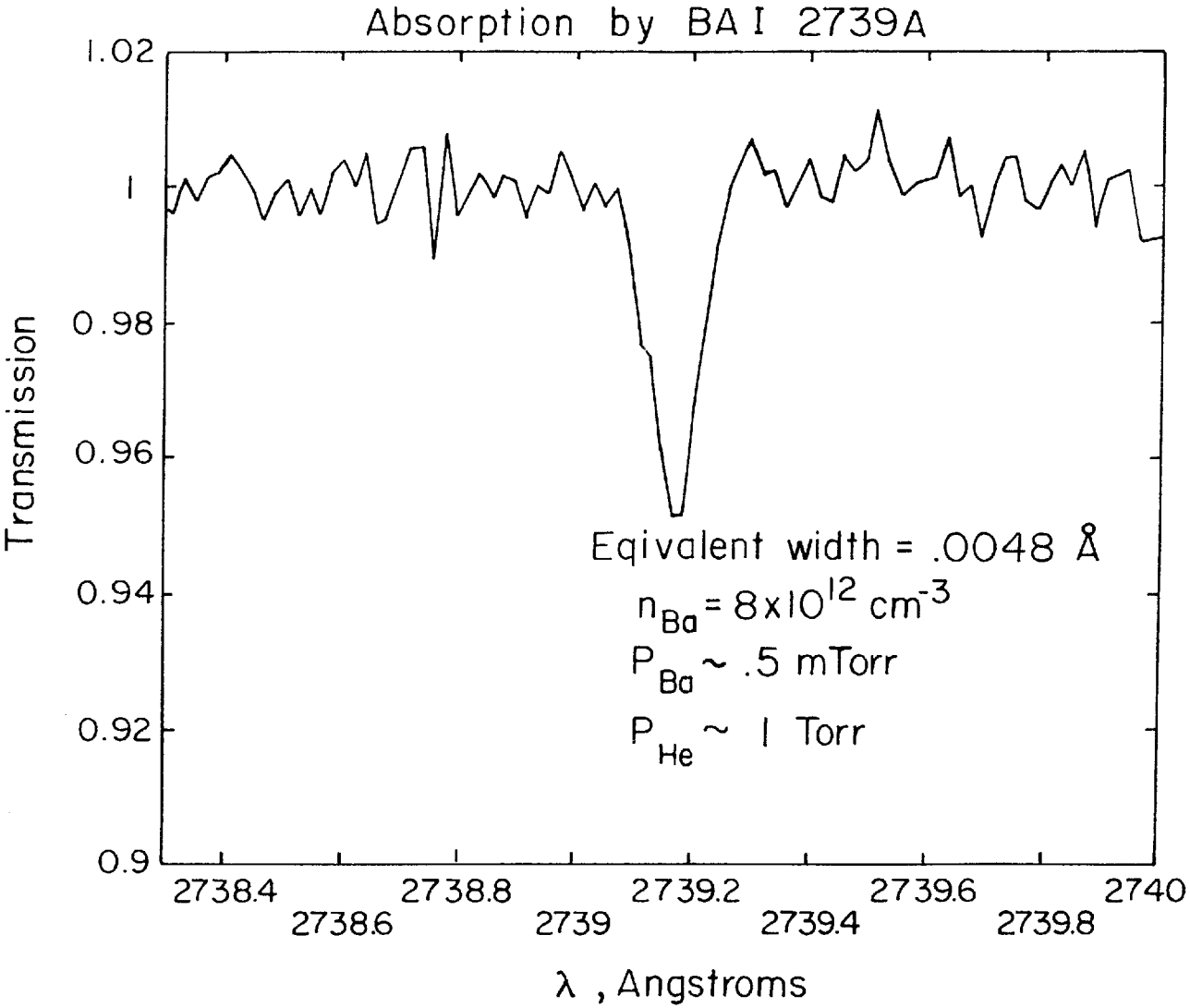
FIG. 28 is a graph showing absorption by Ba I at 2739 Angstroms at a density of $8\times10^{12}$ atoms/$cm^3$.

Another effect observed was the transition from the H-mode to an E-mode discharge. FIG. 27 shows a time sequence of this transition, with the first two spectra representing the H-mode, and the last two representing the E-mode. Qualitatively, this transition corresponds to the bright white light changing to a dim green color.

Figure 25:
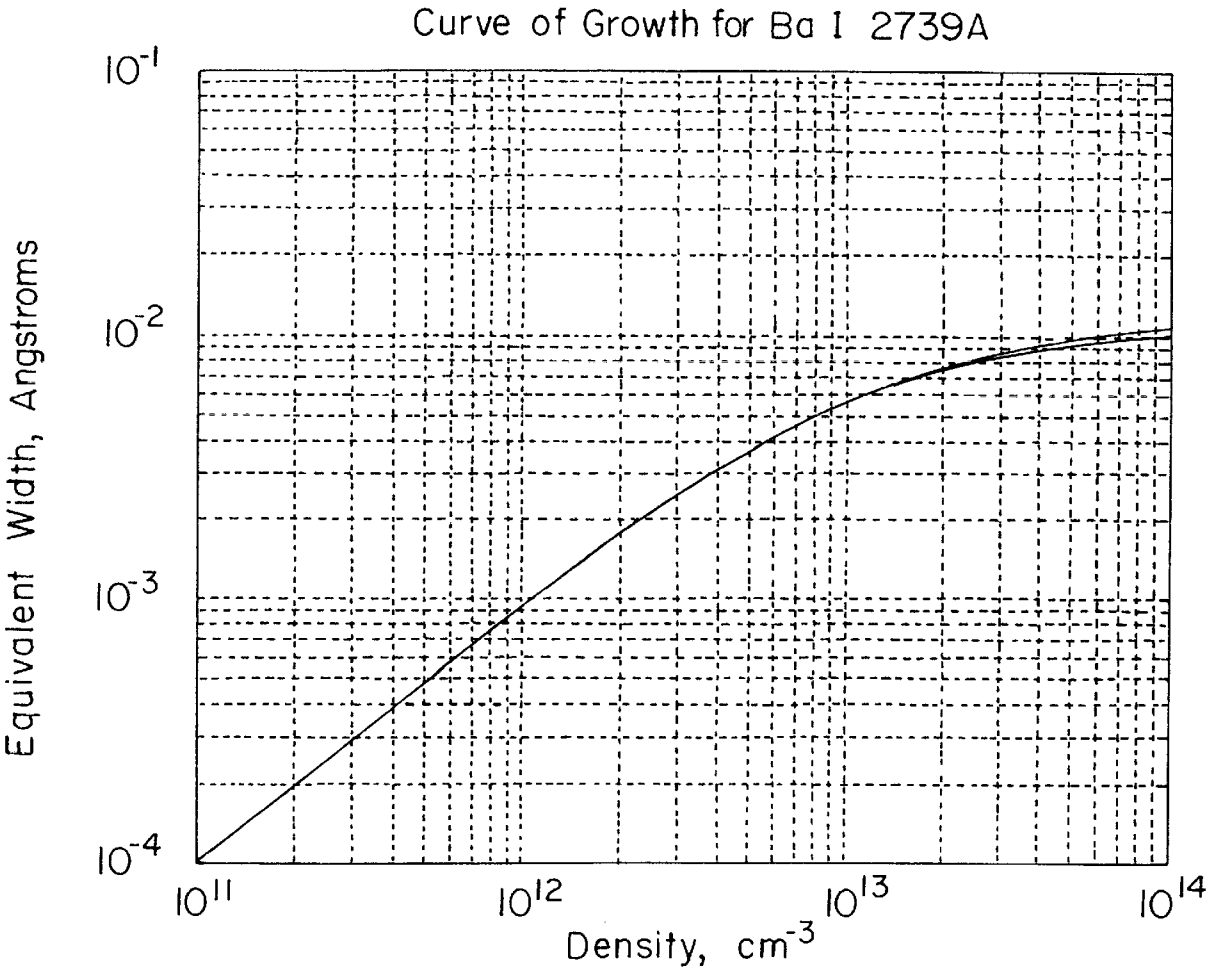
FIG. 25 is a diagram illustrating the curve of growth for Ba I at 2739 Angstroms.
Figure 26:
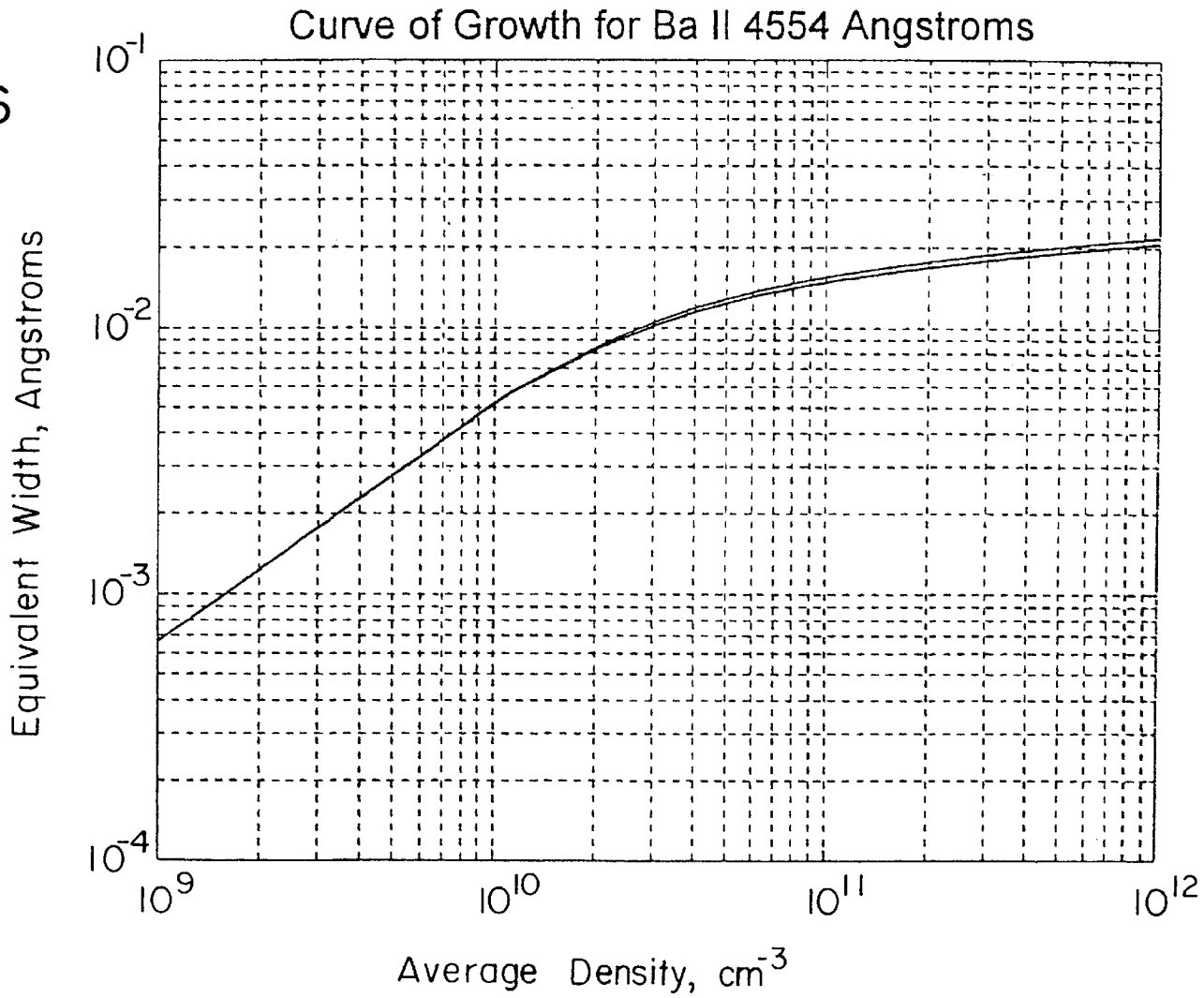
FIG. 26 is a diagram showing the curve of growth for Ba II at 4554 Angstroms.

Absorption measurements were also taken on the barium RF discharge. We followed the standard method outlined above. FIGS. 25 and 26 show the curves of growth based on known quantities of discharge conditions, e.g., cell length, oscillator strengths, transition wavelength, etc.

Several absorption spectra are presented in FIGS. 23, 24, 28 and 32. A goal in making these density measurements was to get an order of magnitude information on excited atoms and ions.

These measurements provide a good set of data for testing models of an RF barium plasma. One item of particular interest was the presence of ion lines in the barium spectrum. While this accounts for the white light, the energy needed to produce the ions might suggest a low efficiency. As mentioned before, one of the advantages of the DC discharge was that it produced excited states more efficiently than ions. However, initial calculations suggest that a significant amount of ion recycling might occur in an RF barium plasma. Ion recycling is the process by which ions are excited and emit photons many times before recombining to form a neutral atom. If an ion can be excited 10 times before recombining, then the initial cost of 5.2 eV to produce the ion is small compared to the amount of light output.

In many ways, this is the starting point in understanding a very complex type of discharge. One of the difficulties of working with an RF discharge is the vast range of parameter space. This makes it difficult to isolate causal relationships. Moreover, some of the parameters are time-dependent, making reproducible results difficult; e.g., the temperature of the circuit elements.

It is thus seen that in accordance with the invention pseudo-white light emission may be obtained with an inductively-coupled discharge that has been dosed with metallic barium. The discharge is initially ignited with a rare-gas fill at pressures of 10–1000 mTorr. Radio frequency power is inductively-coupled to the rare-gas discharge causing the discharge temperature to rise to the 525° to 750° C. range. The vapor pressure of Ba at these temperatures is approximately 1–100 mTorr. At these vapor pressures, the discharge emission is dominated by the Ba I 553.5 nm line, and the Ba II 493.4 and 455.4 nm lines. There is also considerable emission in the red part of the spectrum from several Ba ion lines. Under these conditions rare-gas emission is negligible. The combination of Ba lines results in emission that appear white. Under various conditions, the emission may be made to appear red-white. The presence of the Ba neutral lines is critical to the emission of white light. Without the ion lines, the emission is dominated by the green Ba I 553.5 nm line. Insulation such as fiberglass or a transparent vacuum jacket is placed around the lamp cell to achieve the desired temperatures. Controlling the pressure in the vacuum jacket and the power coupled to the vessel may be used to control the hue of the emitted light, from blue-white to white to red-white, or even monochromatic green by suppressing ion emission.

It is understood that the invention is not confined to the particular embodiments set forth herein as illustrative, but embraces all such forms thereof as come within the scope of the following claims.

What is claimed is:

1. A device for emitting visible light comprising:

a discharge vessel containing an amount of elemental barium and buffer gas fill therein; and a discharge inducer coupled to the discharge vessel to induce a desired discharge temperature and elemental barium vapor pressure therein and to produce from the elemental barium vapor a visible light emission, wherein the amount of elemental barium, the discharge temperature, and the barium vapor pressure are selected such that most of the power of the visible light emitted by the device is provided by spectral emission lines due to elemental barium.

2. The device of claim 1 further comprising at least two electrodes disposed at least partially within the discharge vessel and wherein the discharge inducer is a DC or AC power source connected to the electrodes.

3. The device of claim 1 wherein the discharge inducer is a radio frequency power source.

4. The device of claim 1 wherein the discharge vessel is constructed of material selected from the group consisting of quartz, fused silica, and aluminum oxide.

5. The device of claim 1 wherein the discharge vessel is thermally insulated.

6. A visible light source apparatus comprising:

a discharge vessel containing an amount of elemental barium and a fill gas therein; and a radio frequency power supply inductively coupled to the discharge vessel to induce a desired discharge temperature and elemental barium vapor pressure therein and to produce from the elemental barium vapor a visible light emission, wherein the amount of elemental barium, the discharge temperature, and the barium vapor pressure are selected such that the visible light source apparatus emits visible light in which most of the power of the visible light emitted by the apparatus is provided by spectral emission lines due to elemental barium.

7. The apparatus of claim 6 wherein the discharge vessel is thermally insulated.

8. A method of producing a visible light comprising the steps of:

initially igniting a fill gas at a desired pressure in a discharge vessel containing a selected amount of elemental barium and providing energy to the fill gas to increase the temperature thereof and cause the elemental barium to vaporize, and applying energy to the elemental barium vapor to excite the elemental barium vapor to emit visible light, wherein the amount of elemental barium is selected such that most of the power of the visible light emitted is provided by spectral emission lines due to elemental barium.

9. The method of claim 8 wherein the step of providing energy to the fill gas comprises inductively coupling radio frequency power to the gas in the discharge vessel.

10. The method of claim 8 wherein the discharge vessel contains at least two electrodes disposed at least partially within the discharge vessel, and the step of providing power comprises providing DC or AC power to the electrodes.

11. A method of converting electrical energy to visible light comprising:

(a) enclosing a source of elemental barium in a discharge vessel with a fill gas;

(b) exciting the fill gas within the vessel to heat the elemental barium source to evaporate elemental barium therefrom to provide an elemental barium vapor in the vessel; and (c) applying energy to the elemental barium vapor within the vessel to excite a plasma comprising a mixture of neutral elemental barium and elemental barium ions and exciting the neutral elemental barium and the elemental barium ions to emit light at wavelengths characteristic of the neutral elemental barium and the elemental barium ions, wherein the source of elemental barium is selected such that most of the power of the visible light is provided by the light emitted at wavelengths characteristic of the neutral elemental barium and elemental barium ions.

12. The method of claim 11 wherein applying energy to the barium vapor comprises applying an electrical discharge between electrodes in the vessel and across the plasma.

13. The method of claim 11 wherein applying energy to the barium vapor comprises inductively coupling radio frequency energy to the plasma.

14. The method of claim 11 wherein applying energy to the barium vapor comprises capacitively coupling radio frequency energy to the plasma.

15. The method of claim 11 wherein the fill gas is selected from the group consisting of argon, helium, xenon, krypton, neon, and mixtures thereof.

16. The method of claim 11 wherein the visible light emitted includes light at least at wavelengths centered at 5535 Å from neutral barium atoms.

17. The method of claim 16 wherein the visible light emission further includes emission from barium ions at least at emission wavelengths centered at 4934 Å, 4554 Å, 6141 Å and 6496 Å.

18. The method of claim 11 including providing fill gas in the discharge vessel at a selected pressure that will result in emission of light as energy is applied to the barium vapor that will be visually perceived as white light.

* * * * *